US009840874B2

(12) United States Patent
Vo et al.

(10) Patent No.: US 9,840,874 B2
(45) Date of Patent: Dec. 12, 2017

(54) HYBRID ROLLING CONE DRILL BITS AND METHODS FOR MANUFACTURING SAME

(71) Applicant: National Oilwell DHT, L.P., Conroe, TX (US)

(72) Inventors: Thang Vo, Houston, TX (US); Tjandra Sukendro, Conroe, TX (US)

(73) Assignee: National Oilwell DHT, L.P., Houston, TX (US)

( * ) Notice: Subject to any disclaimer, the term of this patent is extended or adjusted under 35 U.S.C. 154(b) by 0 days.

(21) Appl. No.: 14/985,786

(22) Filed: Dec. 31, 2015

(65) Prior Publication Data

US 2016/0108681 A1 Apr. 21, 2016

Related U.S. Application Data

(63) Continuation of application No. 13/679,346, filed on Nov. 16, 2012, now Pat. No. 9,249,628.

(51) Int. Cl.

| | |
|---|---|
| ***E21B 10/16*** | (2006.01) |
| ***B24D 3/06*** | (2006.01) |
| ***E21B 10/52*** | (2006.01) |

(52) U.S. Cl.

CPC ..... *E21B 10/16* (2013.01); *B24D 3/06* (2013.01); *E21B 10/52* (2013.01)

(58) Field of Classification Search

CPC ..... E21B 10/006; E21B 10/16; E21B 10/52; E21B 10/567; E21B 10/58; B24D 3/06; B23P 15/28; B28D 1/02; B28D 1/12

See application file for complete search history.

(56) References Cited

U.S. PATENT DOCUMENTS

| | | | | |
|---|---|---|---|---|
| 2,102,305 A * | 12/1937 | Chormann | B28D 1/122 | 76/112 |
| 2,104,822 A * | 1/1938 | Scott | E21B 10/16 | 175/375 |
| 2,168,060 A * | 8/1939 | Catland | E21B 10/50 | 175/375 |
| 2,669,432 A | 2/1954 | Dill et al. | | |
| 2,804,282 A * | 8/1957 | Spengler, Jr. | E21B 10/16 | 175/378 |
| 3,126,067 A | 3/1964 | Schumacher, Jr. | | |
| 3,343,308 A * | 9/1967 | Fessel | B23D 61/185 | 125/15 |

(Continued)

FOREIGN PATENT DOCUMENTS

GB 2324555 A 10/1998

OTHER PUBLICATIONS

PCT/US2013/069394 International Search Report and Written Opinion dated Oct. 8, 2014 (18 p.).

(Continued)

*Primary Examiner* — Jennifer H Gay

(74) *Attorney, Agent, or Firm* — Conley Rose, P.C.

(57) ABSTRACT

A rolling cone drill bit for drilling a borehole in earthen formations includes a bit body having a bit axis. In addition, the rolling cone drill bit includes a rolling cone cutter mounted on the bit body and having a cone axis of rotation. The cone cutter includes a cone body, a plurality of teeth arranged in a first inner row, and a plurality of inserts. Each insert is disposed within one tooth in the first inner row.

16 Claims, 19 Drawing Sheets

(56) References Cited

U.S. PATENT DOCUMENTS 3,401,759 A * 9/1968 White ..... E21B 10/16 175/341
3,495,670 A 2/1970 Ditson
3,581,835 A 6/1971 Stebley
4,047,583 A 9/1977 Dyer
4,187,922 A * 2/1980 Phelps ..... E21B 10/52 175/374
4,262,761 A 4/1981 Crow
4,339,009 A 7/1982 Busby
4,592,252 A 6/1986 Ecer
4,597,456 A 7/1986 Ecer
4,854,405 A 8/1989 Stroud
5,131,480 A 7/1992 Lockstedt et al.
5,248,006 A 9/1993 Scott et al.
5,348,108 A 9/1994 Scott et al.
5,351,768 A 10/1994 Scott et al.
5,467,669 A 11/1995 Stroud
5,492,188 A 2/1996 Smith et al.
5,579,856 A 12/1996 Bird
5,592,995 A 1/1997 Scott et al.
5,737,980 A 4/1998 Keith et al.
5,839,526 A 11/1998 Cisneros et al.
5,868,213 A 2/1999 Cisneros et al.
5,921,333 A 7/1999 Hewitt
5,979,575 A 11/1999 Overstreet et al.
6,176,329 B1 * 1/2001 Portwood ..... E21B 10/16 175/341
6,290,008 B1 9/2001 Portwood et al.
6,564,884 B2 5/2003 Bird
6,766,870 B2 * 7/2004 Overstreet ..... E21B 10/50 175/374
6,932,172 B2 8/2005 Dvorachek
7,040,424 B2 * 5/2006 Yong ..... E21B 10/52 175/374
7,152,701 B2 12/2006 Butland et al.
7,240,746 B2 * 7/2007 Overstreet ..... E21B 17/1092 175/374
7,631,709 B2 12/2009 McDonough et al.
9,249,628 B2 * 2/2016 Vo ..... E21B 10/52
2002/0017402 A1 2/2002 Bird
2004/0173384 A1 * 9/2004 Yong ..... E21B 10/52 175/374
2005/0077091 A1 4/2005 Butland et al.
2006/0090937 A1 5/2006 McDonough
2008/0164069 A1 7/2008 McDonough et al.
2009/0229887 A1 * 9/2009 Tedeschi ..... E21B 10/16 175/374
2010/0314176 A1 12/2010 Zhang et al.
2011/0024200 A1 2/2011 Digiovanni et al.
2011/0284293 A1 11/2011 Shen et al.
2012/0273280 A1 * 11/2012 Zhang ..... E21B 10/573 175/428
2013/0098688 A1 * 4/2013 Yong ..... E21B 10/22 175/227
2014/0138161 A1 5/2014 Vo et al.

OTHER PUBLICATIONS

Response to Written Opinion dated Oct. 8, 2014 and Article 19 Amendments, for PCT/US2013/069394 (24 p.).
Restriction Requirement dated Dec. 26, 2014, for U.S. Appl. No. 13/679,346 (7 p.).
Response to Restriction Requirement dated Dec. 26, 2014, for U.S. Appl. No. 13/679,346; Response filed Feb. 2, 2015 (11 p.).
Office Action dated Feb. 23, 2015, for U.S. Appl. No. 13/679,346 (11 p.).
Response to Office Action dated Feb. 23, 2015, for U.S. Appl No. 13/679,346; Response filed May 22, 2015 (35 p.).
Final Office Action dated Jun. 8, 2015, for U.S. Appl. No. 13/679,346 (15 p.).
Response to Final Office Action dated Jun. 8, 2015, for U.S. Appl. No. 13/679,346; Response filed Sep. 14, 2015 (39 p.).
Notice of Allowance dated Sep. 23, 2015 for U.S. Appl. No. 13/679,346 (8 p.).

* cited by examiner

HYBRID ROLLING CONE DRILL BITS AND METHODS FOR MANUFACTURING SAME

CROSS-REFERENCE TO RELATED APPLICATIONS

This application is a continuation of U.S. application Ser. No. 13/679,346 filed Nov. 16, 2012, and entitled "Hybrid Rolling Cone Drill Bits and Methods for Manufacturing Same," which is incorporated herein by reference.

STATEMENT REGARDING FEDERALLY SPONSORED RESEARCH OR DEVELOPMENT

Not applicable.

BACKGROUND OF THE TECHNOLOGY

Field of the Invention

The invention relates generally to earth-boring bits used to drill a borehole for the ultimate recovery of oil, gas or minerals. More particularly, the invention relates to rolling cone rock bits and to an improved cutting structure for such bits.

Background Information

An earth-boring drill bit is connected to the lower end of a drill string and is rotated by rotating the drill string from the surface, with a downhole motor, or by both. With weight-on-bit (WOB) applied, the rotating drill bit engages the formation and proceeds to form a borehole along a predetermined path toward a target zone. The borehole formed in the drilling process will have a diameter generally equal to the diameter or "gage" of the drill bit. The length of time that a drill bit may be employed before it must be changed depends upon its ability to "hold gage" (meaning its ability to maintain a full gage borehole diameter), its rate of penetration ("ROP"), as well as its durability or ability to maintain an acceptable ROP.

In oil and gas drilling operations, costs are generally proportional to the length of time it takes to drill the borehole to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section-by-section. Once the drill string has been retrieved and the new bit installed, the bit must be lowered to the bottom of the borehole on the drill string, which again must be constructed section-by-section. This process, known as a "trip" of the drill string, requires considerable time, effort and expense. Since drilling costs are typically one the order of thousands of dollars per hour, it is desirable to employ drill bits which will drill faster and longer, and which are usable over a wider range of formation hardnesses.

One common type of earth-boring bit, referred to as a rolling cone or cutter bit, includes one or more rotatable cone cutters, each provided with a plurality of cutting elements. During drilling with WOB applied, the cone cutters roll and slide upon the bottom of the borehole as the bit is rotated, thereby enabling the cutting elements to engage and disintegrate the formation in its path. The borehole is formed as the cutting elements gouge and scrape or chip and crush the formation. The chips of formation are carried upward and out of the borehole by drilling fluid which is pumped downwardly through the drill pipe and out of the bit.

Cutting elements provided on the rolling cone cutters are typically one of two types—inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "insert" bits, while those having teeth formed from the cone material are commonly known as "milled tooth bits." The shape and positioning of the cutting elements (both teeth and inserts) upon the cone cutters greatly impact bit durability and ROP, and thus, are important to the success of a particular bit design.

The inserts in insert bits are typically positioned in circumferential rows on the rolling cone cutters. Specifically, most insert bits include a radially outermost heel row of inserts positioned to cut the borehole sidewall, a gage row of inserts radially adjacent the heel row and positioned to cut the corner of the borehole, and multiple inner rows of inserts radially inward of the gage row and positioned to cut the bottom of the borehole. The inserts in the heel row, gage row, and inner rows can have a variety of different geometries.

Particular cutting elements may be more well suited in particular types of formations. For example, milled teeth may be more effective in softer formations. However, the relative softness of milled teeth as compared to inserts may cause the teeth to erode and wear rapidly when engaging harder formations. Once the cutting structure is damaged (e.g., teeth worn and/or broken), the rate of penetration may be reduced to an unacceptable rate, the drill string must be removed in order to replace the drill bit. Inserts made of relatively hard materials (e.g., material containing a high percentage of tungsten carbide) are usually more effective in harder formations. However, inserts often have smaller cutting surfaces as compared to milled teeth, reducing their effectiveness in softer formations. Further, formations may contain both relatively hard and soft zones, reducing the effectiveness and drilling efficiency of a rolling cone bit having only either inserts or milled teeth.

Accordingly, there remains a need in the art for drill bits that provide a relatively high rate of penetration and footage drilled, yet are durable enough to withstand hard and abrasive formations that may quickly damage milled teeth of a rolling cone bit. Such drill bits and cutting elements would be particularly well received if they offered the potential to improve overall drilling efficiency in formations including both soft and hard zones without the need for tripping the bit out of the hole in order to exchange drill bits.

BRIEF SUMMARY OF THE PREFERRED EMBODIMENTS

These and other needs in the art are addressed in one embodiment by a rolling cone bit for drilling a borehole in earthen formations. In an embodiment, the rolling cone bit comprises a bit body having a bit axis. In addition, the rolling cone bit comprises a rolling cone cutter mounted on the bit body and having a cone axis of rotation. The cone cutter includes a cone body, a plurality of teeth arranged in a first inner row and a plurality of inserts. Each insert is disposed within one tooth in the first inner row.

These and other needs in the art are addressed in another embodiment by a rolling cone drill bit for drilling a borehole in earthen formations. In an embodiment, the rolling cone bit comprises a bit body having a bit axis. In addition, the bit comprises a rolling cone cutter mounted on the bit body and having a cone axis of rotation. The cone cutter includes a cone body, a plurality of teeth arranged in a first inner row and a plurality of inserts disposed in the first inner row. Further, the first inner row is positioned immediately circumferentially adjacent one tooth in the first inner row. Each insert in the first inner row trails the immediately circumferentially adjacent tooth in the first inner row relative to a direction of cone rotation about the cone axis.

These and other needs in the art are addressed in another embodiment by a method of forming a drill bit for cutting a borehole. In an embodiment, the method comprises positioning a plurality of inserts in a mold. In addition, the method comprises filling the mold with a metal powder. Further, the method comprises surrounding at least a portion of each insert with the metal powder during the process of filling the mold with a metal powder. Still further, the method comprises sintering the metal powder in the mold to form a cone cutter having a cone body and a plurality of teeth extending from the cone body. Each insert is secured to the cone body.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
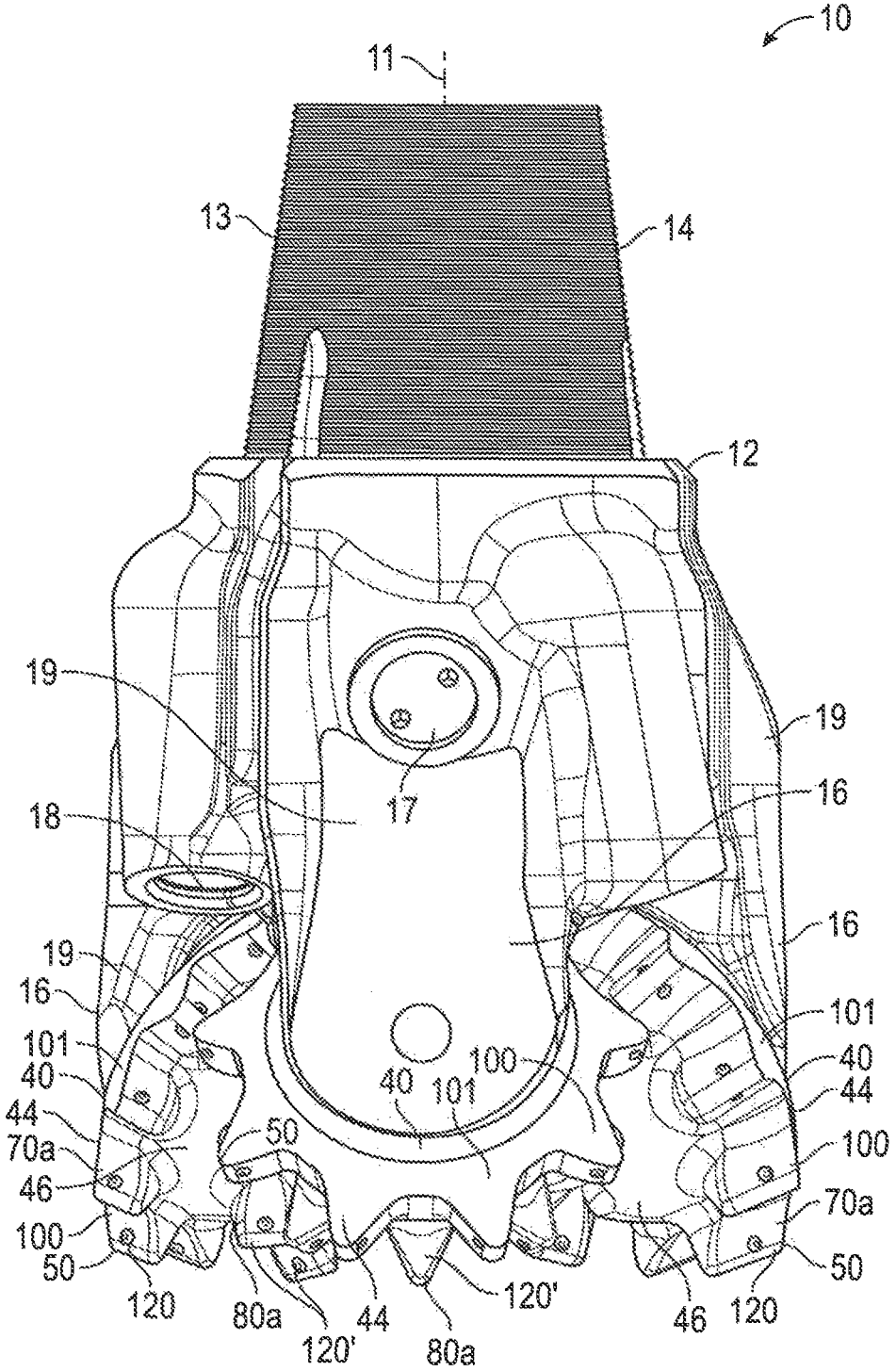
FIG. 1 is a perspective view of an embodiment of an earth-boring bit in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port, while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, an embodiment of a rolling cone drill bit 10 is shown. Bit 10 has a central axis 11 and includes a bit body 12 with an externally threaded pin 13 at its upper end and a plurality of rolling cone cutters 100 rotatably mounted on bearing shafts that depend from the bit body 12. Pin end 14 is adapted to secure bit 10 to a drill string (not shown). Bit body 12 is formed of three sections or legs 19 welded together and has a predetermined gage diameter defined by the outermost reaches of cone cutters 100.

Bit 10 also includes a plurality of nozzles 18 (one shown in FIG. 1) and lubricant reservoirs 17 (one shown in FIG. 1). Nozzles 18 direct drilling fluid toward the bottom of the borehole and around cone cutters 100. Reservoirs 17 supply lubricant to the bearings that support each of the cone cutters 100. Bit legs 19 include a shirttail portion 16 that serves to protect the cone bearings and seals, described in more detail below, from formation cuttings and debris that seek to enter between leg 19 and its respective cone cutter 100 during drilling operations.

Figure 2:
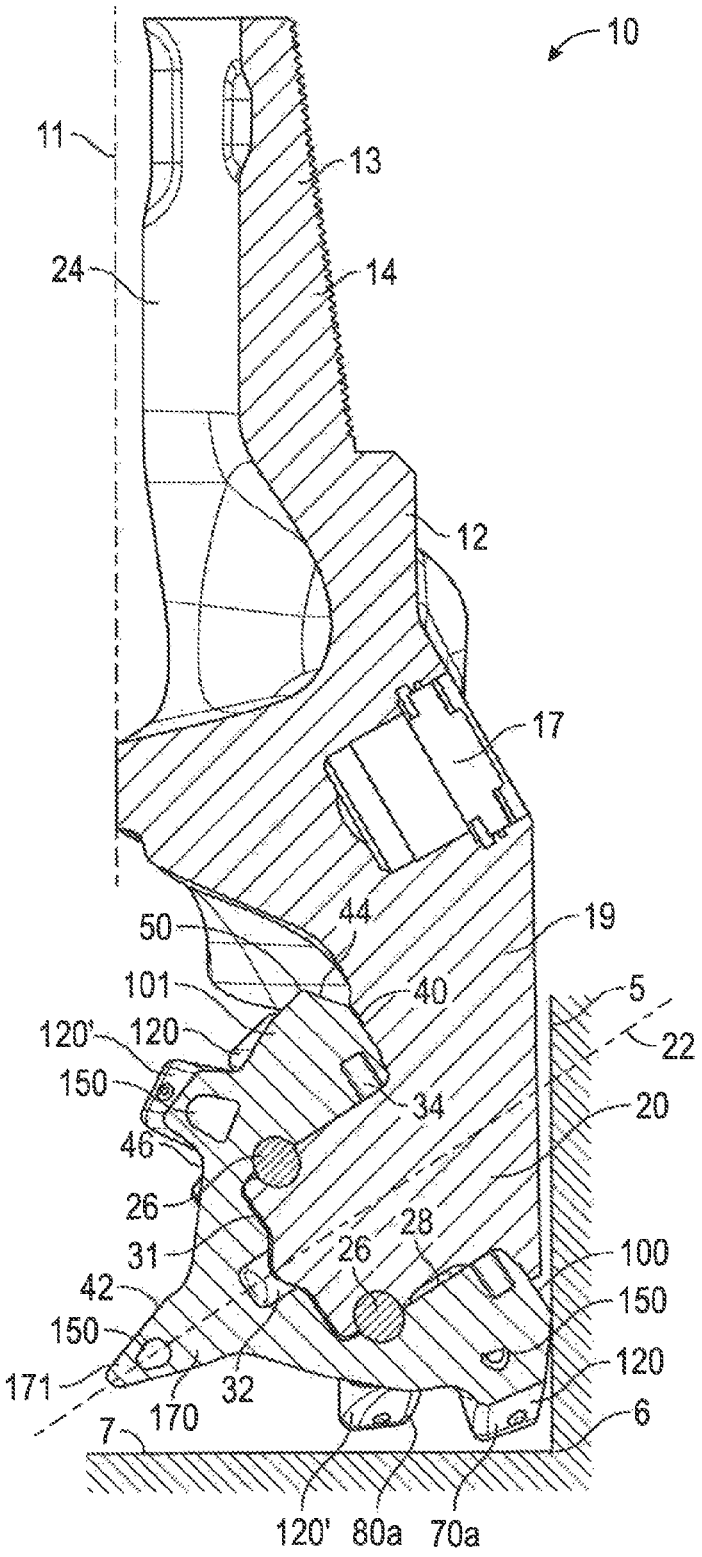
FIG. 2 is a partial cross-sectional view taken through one leg and one rolling cone cutter of the bit of FIG. 1.

Referring now to both FIGS. 1 and 2, each cone cutter 100 is rotatably mounted on a journal 20 extending radially inward at the lower end of one leg 19, and has a central axis of rotation 22 oriented generally downwardly and inwardly toward bit axis 11. Each cutter 100 is secured on its corresponding journal 20 with locking balls 26. In this embodiment, journal bearings 28, thrust washer 31, and thrust plug 32 are provided between each cone cutter 100 and journal 20 to absorb radial and axial thrusts. In other embodiments, roller bearings may be provided between each cone cutter 100 and associated journal pin 20 instead of journal bearings 28. In both journal bearing and roller bearing bits, lubricant is supplied from reservoir 17 to the bearings by apparatus and passageways that are omitted from the figures for clarity. The lubricant is sealed in the bearing structure, and drilling fluid excluded therefrom, with an annular seal 34. Drilling fluid is pumped from the surface through fluid passage 24 at pin end 13 and is circulated through an internal passageway (not shown) to nozzles 18 (FIG. 1). As best shown in FIG. 2, the borehole created by bit 10 includes sidewall 5, corner portion 6 and bottom 7.

Referring still to FIGS. 1 and 2, each cone cutter 100 includes a body 101, a plurality of gage teeth 120 and inner teeth 120' extending from body 101, and a plurality of wear resistant inserts 150 mounted to body 101. As will be described in more detail below, each insert 150 is disposed within one tooth 120, 120', and further, each tooth 120, 120' is integral with body 101. Each cone body 101 includes a generally planar backface 40 and nose 42 opposite backface 40. Moving axially relative to cone axis 22 from backface 40 to nose 42, each cone body 101 further includes a generally frustoconical heel surface 44 and a generally convex curved surface 46 extending from heel surface 44 to nose 42. As best shown in FIG. 1, frustoconical heel surface 44 and convex surface 46 intersect at an annular edge or shoulder 50.

Heel surface 44 is adapted to scrape or ream the borehole sidewall 5 of the borehole as the cone cutter 100 rotates about the borehole bottom 7. Teeth and/or inserts may be provided in heel surface 44 to aid in such scraping or reaming action. It should be appreciated that heel surface 44 may be referred to by others in the art as the "gage" surface of a rolling cone cutter. Surface 46 supports a plurality of cutting elements that gouge or crush the borehole bottom 7 as cone cutters 100 rotate about the borehole. During drilling operations, bit 10 is rotated about axis 11 in a clockwise cutting direction looking downward at pin end 13 along axis 11 and each cone cutter 100 rotates about axis 22 in a counterclockwise cutting direction looking at backface 40 along axis 22.

Referring now to FIGS. 2-4B, teeth 120, 120', and inserts 150 disposed therein, are arranged in a plurality of axially spaced (relative to cone axis 22) circumferential rows. More specifically, each cone cutter 100 includes a first or gage circumferential row 70*a* of teeth 120 extending from surface 46 axially adjacent shoulder 50 and a second circumferential row 80*a* of teeth 120' extending from surface 46 and axially disposed between row 70*a* and nose 42. Teeth 120 in row 70*a* function primarily to cut the corner 6 of the borehole while teeth 120' in row 80*a* function to cut the bottom 7 of the borehole. Rows 70*a* and 80*a* of teeth 120, 120', are arranged and spaced on each rolling cone cutter 100 so as not to interfere with teeth 120, 120', on the other cone cutters 100 (FIG. 1). Each cone cutter 100 is also provided with a "ridge" cutting element 170 extending from nose 42 and configured to prevent formation build-up between the cutting paths of teeth 120 in row 70*a* and teeth 120' in row 80*a*. Element 170 extends along axis 22 (FIG. 2) and includes four circumferentially adjacent teeth 171. Teeth 171 of each element 170 intersect at axis 22. Each cone cutter 100 has a gage row 70*a* of teeth 120, an inner row 80*a* of teeth 120, and a ridge cutting element 170, although not identically arranged and positioned. In particular, the arrangement and spacing of teeth 120, 120', and elements 170 differs as between the three cone cutters 100 in order to maximize borehole bottom coverage, and also to provide clearance for the teeth 120, 120', and elements 170 on the adjacent cone cutters 100.

Each tooth 120, 120', and 171 is integral and unitary with the corresponding body 101. In other words, each tooth 120, 120', and 171 is monolithic with the corresponding body 101 such that teeth 120, 120', 171 and the body 101 are a single-piece. Thus, as used herein and is common terminology in the art, the terms "tooth" and "teeth" refer to individual and multiple, respectively, cutting structures for engaging the formation that extend from and monolithic (i.e., unitary and integral) with the body of a corresponding rolling cone cutter.

Figure 3:
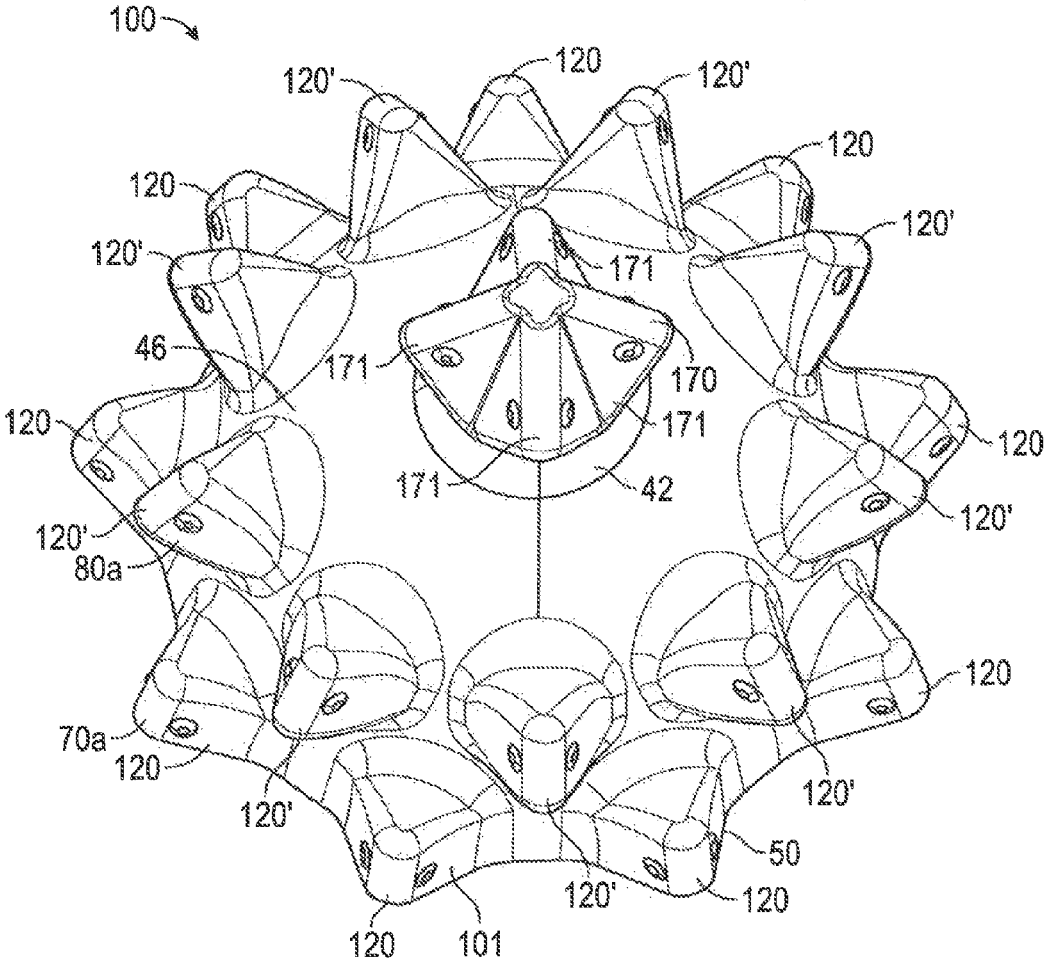
FIG. 3 is a perspective view of one of the rolling cone cutters of the bit of FIG. 1.
Figure 4A:
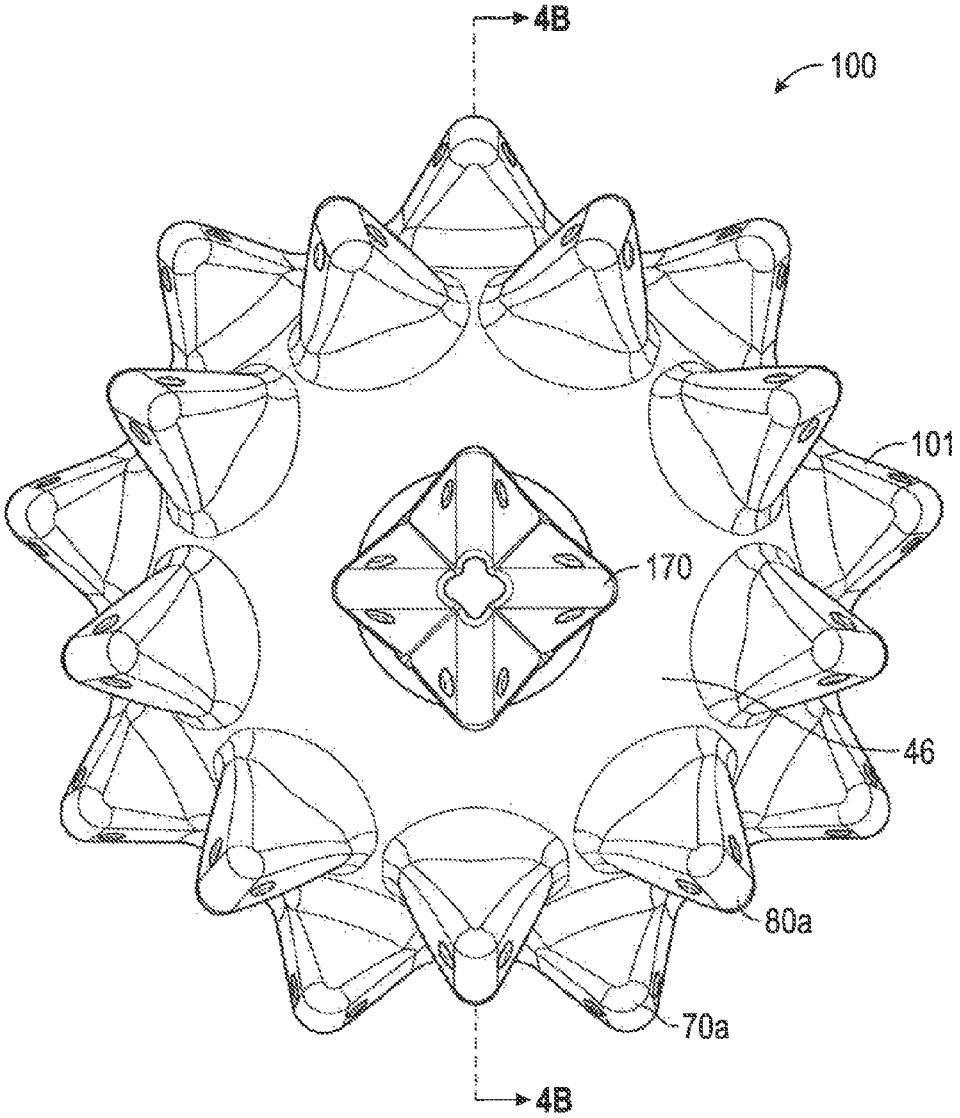
FIG. 4A is a top view of the rolling cone cutter of FIG. 3.
Figure 4B:
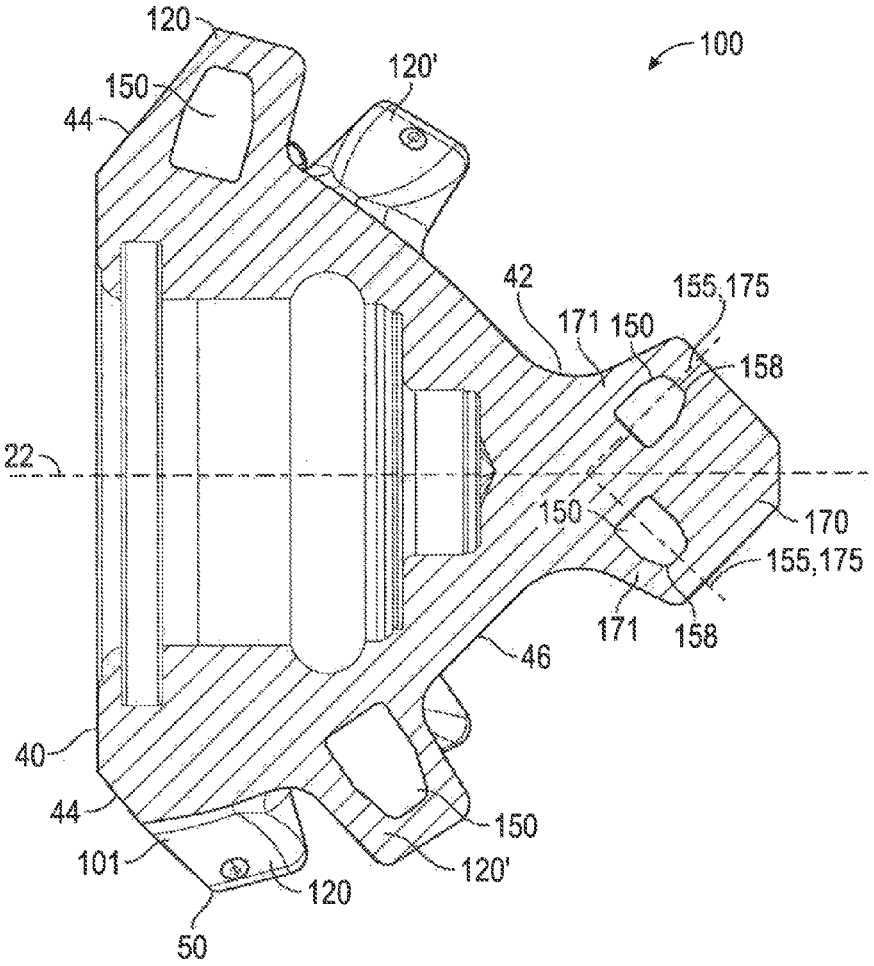
FIG. 4B is a cross-sectional view taken along line 4B-4B of FIG. 4A.
Figure 5A:
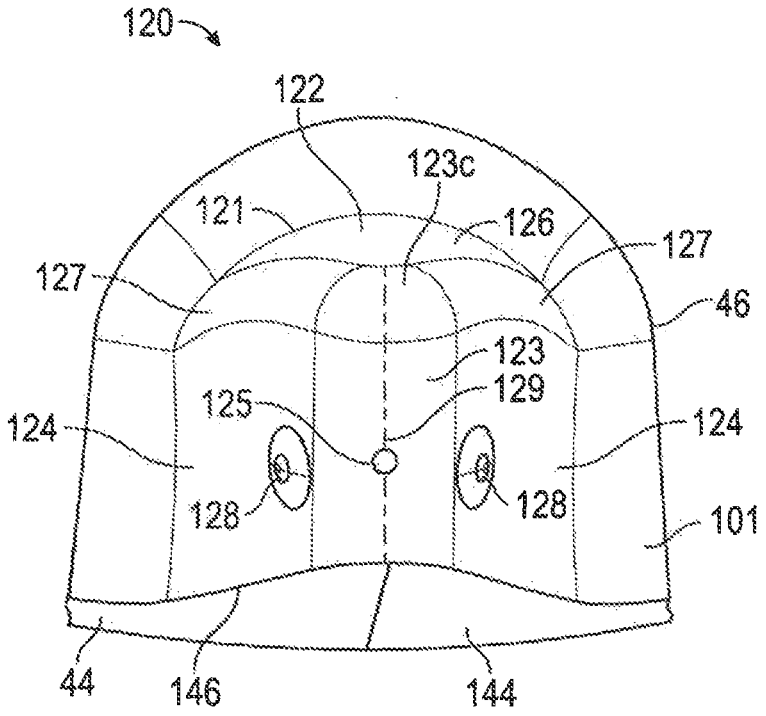
FIGS. 5A-5C are enlarged views of one gage tooth, one inner row tooth and the nose tooth, respectively, of the rolling cone cutter of FIG. 3.

Referring now to FIGS. 3 and 5A, each tooth 120 of row 70*a* extends perpendicularly from body 101 and has a generally chisel-shaped cutting structure for engaging the formation. In particular, each tooth 120 has a central axis 125, a base 121 at surface 46, and a cutting surface 122 extending from base 121 to an elongate chisel-crest 123 distal body 101. In this embodiment, base 121 is generally U-shaped. Cutting surface 122 includes a pair of planar flanking surfaces 124, and a convex lateral side surface 126. Surface 122 further includes a planar surface 144 that extends from and is generally coplanar with heel 44. Surface 144 extends from base 121 to a curved edge 146 that extends between flanking surfaces 124. Flanking surfaces 124 taper or incline towards one another as they extend from base 121 to chisel crest 123 that extends between edge 146 and crest end or corner 123*c*. In this embodiment, crest end 123*c* is a partial sphere, defined by a spherical radius. Lateral side surface 126 extends from base 121 to crest end 123*c* and between flanking surfaces 124. Surfaces 124, 126 intersect at rounded edges 127 that extend from base 121 to corners 123*c* and provide a smooth transition between surfaces 124, 126. A protrusion 128 extends from each flanking surface 124 proximal crest 123. Each chisel crest 123 extends linearly along a crest median line 129. Teeth 120 are arranged and positioned such that a projection of each crest median line 129 intersects cone axis 22 of the corresponding cone cutter 100. As will be described in more detail below, one insert 150 is disposed within each tooth 120.

Figure 5B:
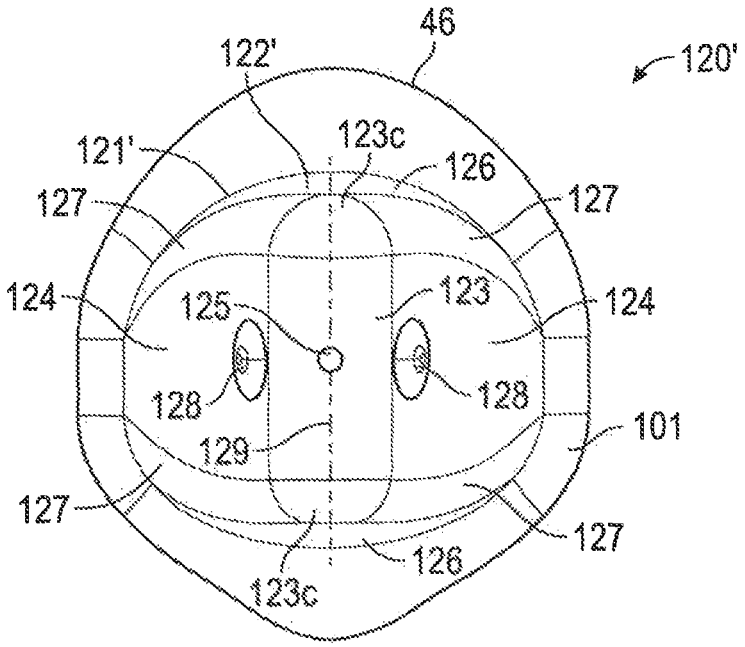

Referring now to FIGS. 3 and 5B, each tooth 120' of row 70*a* is configured similarly to teeth 120 of row 70*a*, and thus similar features are numbered alike. However, base 121' of tooth 120' has a generally elliptical shape and cutting surface 122' of tooth 120' includes a pair of lateral side surfaces 126 extending from base 121' that intersect a pair of crest ends 123*c* between flanking surfaces 124. Also, as will be described below, one insert 150 is disposed within each tooth 120'.

Figure 5C:
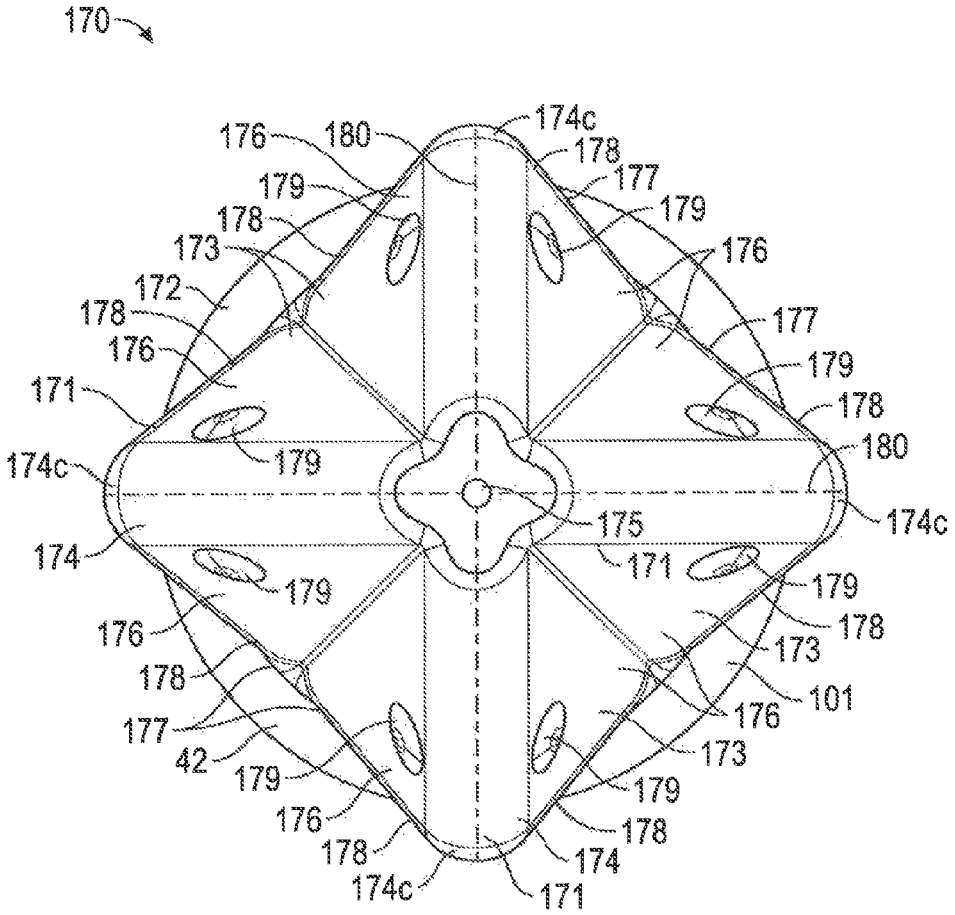

Referring now to FIGS. 3 and 5C, each element 170 extends perpendicularly from nose 42 of body 101 and has a central axis 175 coincident with cone axis 22. As previously described, each element 170 comprises four teeth 171 that intersect at axes 22, 175. Similar to teeth 120 previously described, each tooth 171 has a generally chisel-shaped cutting structure for engaging the formation. In particular, each element 170 has a generally circular base 172 at nose 42, and each tooth 171 has a cutting surface 173 extending from base 172 to an elongate chisel-crest 174 distal body 101. Each cutting surface 173 includes a pair of planar flanking surfaces 176 and a radially outer (relative to axis 22, 175) convex lateral side surface 177. Flanking surfaces 176 taper or incline towards one another as they extend from base 172 to chisel crest 174 that extends from a radially outer crest end or corner 174*c* to axes 22, 175 and crests 174 of the other teeth 171. In this embodiment, crest ends 174*c* are partial spheres, each defined by spherical radii. Lateral side surfaces 177 extend from base 101 to crest end 123*c* and between flanking surfaces 176. Surfaces 176, 177 intersect at rounded edges 178 that extend from base 172 to corner 174*c* and provide a smooth transition between surfaces 176, 177. A protrusion 179 extends from each flanking surface 176 proximal crest 174. Each chisel crest 174 extends linearly along a crest median line 180. Teeth 171 are arranged and positioned such that a projection of each crest median line 180 intersects cone axis 22 of the corresponding cone cutter 100. As will be described in more detail below, one insert 150 is disposed within each tooth 171.

Figure 6:
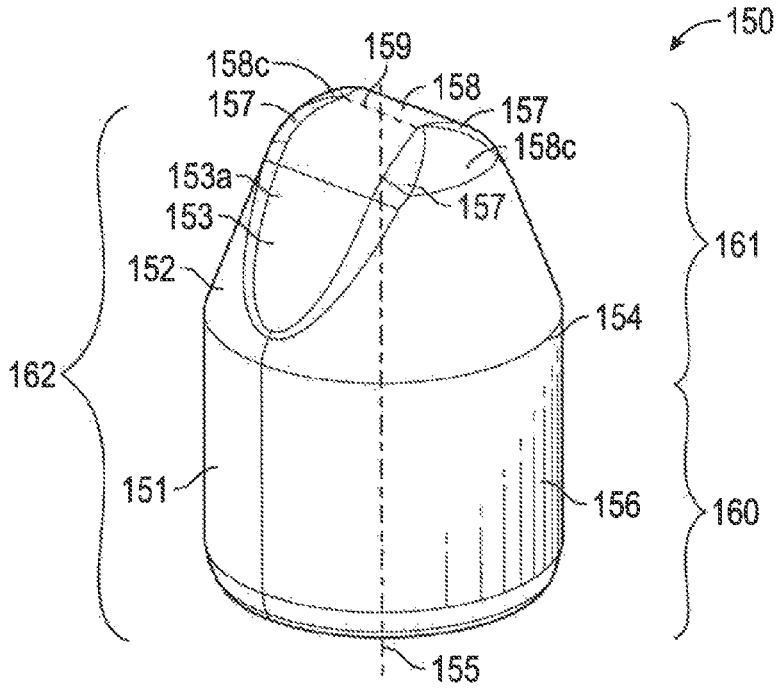
FIG. 6 is a perspective view of the insert disposed within each tooth of FIGS. 5A-5C.

Referring now to FIGS. 2, and 5A-6, one insert 150 is disposed inside of each tooth 120, 120' and 171. As best shown in FIG. 6, each insert 150 includes a base portion 151 and a cutting portion 152 extending axially therefrom. Cutting portion 152 includes a chisel-shaped cutting surface 153 extending from the reference plane of intersection 154 that divides base 151 and cutting portion 152. In this embodiment, base portion 151 is generally cylindrical, having a central axis 155 and an outer cylindrical surface 156. Base portion 151 has an axial height 160, and cutting portion 152 has an axial height 161. Collectively, base 151 and cutting portion 152 define the insert's overall height 162.

Cutting surface 153 includes a pair of planar flanking surfaces 153*a* and a pair of convex lateral side surfaces 157. Flanking surfaces 153*a* generally taper or incline towards one another and intersect at an elongate chisel crest 158 distal base portion 151. Crest 158 extends linearly along a crest medial line 159 between crest ends or corners 158*c*. In this embodiment, crest ends 158*c* are partial spheres, each defined by spherical radii. In this embodiment, each insert 150 is positioned within one tooth 120, 120' and 171 such that a projection of median line 159 intersects axis 22 of the corresponding cone cutter 20, and a projection of axis 155 intersects and is oriented perpendicular to median line 129, 180 of the crest 123, 174, respectively, of the corresponding tooth 120, 120' and 171, respectively. Thus, crest 158 and crest 123, 174 of the corresponding tooth 120, 120' and 171, respectively, are oriented parallel to each other, but are spaced apart. Further, axis 155 and axis 125, 175 of the corresponding tooth 120, 120' and 171, respectively, are parallel, and more specifically, coincident in this embodiment.

Depending upon the type of formation being drilled, it may be beneficial to have a cutting element formed of a harder but less ductile material while in others it may be beneficial to have a cutter formed from a softer, yet more ductile material. Further, a single given formation may have regions of varying hardness, necessitating the swapping of cutting elements having varying configurations and materials of construction during a drilling operation in order to maintain a high ROP over the entire length of the operation. Because the swapping of a cutting element during a drilling operation may be a lengthy and expensive process (i.e., requiring tripping of the drillstring), it would be beneficial to have a cutting structure configured to operate in a formation that includes both soft and hard formation regions. For instance, a "hybrid" bit such as bit 10 including teeth 120, 120' and 171 and inserts 150 offers the potential to enable drilling of a formation having both soft and hard regions without the need for swapping the bit in order to maintain a high ROP. Specifically, during drilling operations, softer regions of the formation are often encountered first, followed by harder regions of formation. Thus, by positioning inserts 150 within teeth 120, 120' and 171, teeth 120, 120' and 171 can provide the initial cutting structure for engaging softer formations, while inserts 150 can provide a secondary cutting structure for engaging harder formations as teeth 120, 120' and 171 erode. In other words, teeth 120, 120' and 171 sacrificially erode during the initial stages of drilling operations, thereby exposing inserts 150 for subsequent stages of drilling operations where harder regions of the formation are encountered.

Figure 11:
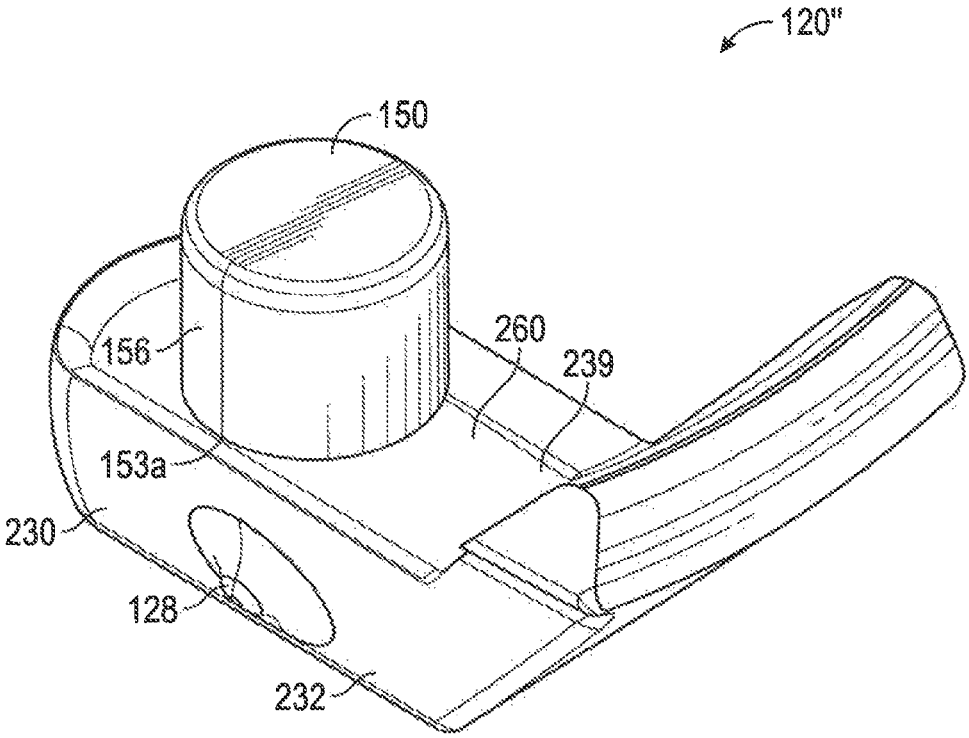
FIG. 11 is a perspective view of a partially preformed inner row tooth of the bit of FIG. 3.

A molding method is used to partially preform (a) each tooth 120, 120', with one insert 150 disposed therein at a predetermined distance measured between crests 123, 158, and (b) each ridge cutting element 170 with one insert 150 disposed within each tooth 171 at a predetermined distance measured between crests 123, 174. One partially preformed gage tooth 120 of row 70*a* is shown in FIG. 11 and designated with reference numeral 120". Once partially preformed gage teeth 120" (with insert 150 disposed therein), partially preformed inner teeth 120' (with insert 150 disposed therein) and a partially preformed cutter element 174 (with inserts 150 disposed therein) is made, a subsequent molding method is used to simultaneously form the corresponding cone body 101, form the remainder of teeth 120, 120' and 171, and monolithically combine teeth 120, 120' and 171 with the cone body 101. These molding methods will now be described with respect to teeth 120, it being understood that the same molding methods are employed for each cutting element 170.

Figure 7:
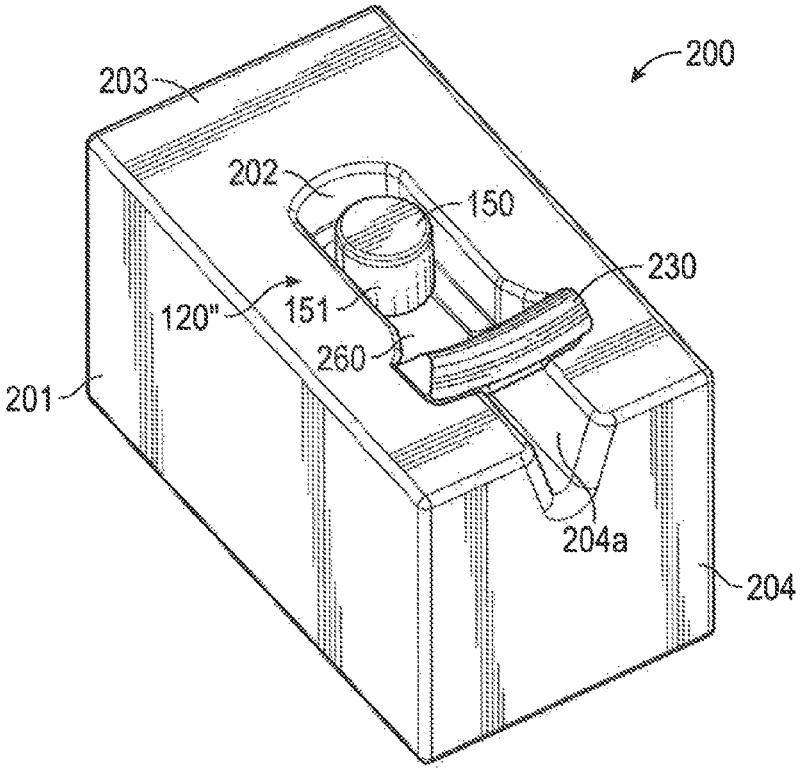
FIG. 7 is a perspective view of an embodiment of a mold assembly for partially preforming one inner row tooth of the bit of FIG. 3.

Referring now to FIG. 7, a mold assembly 200 for partially preforming one tooth 120 with an insert 150 disposed therein is shown. In this embodiment, mold assembly 200 includes a fixture 201, a hard metal inlay or cap 230 disposed within fixture 201, an insert 150 seated in cap 230, and filling material 260 disposed within cap 230 and encapsulating cutting portion 152 of insert 150. Fixture 201 includes a mold recess or negative 202 from an upper or top surface 203 of fixture 201, and an access channel 204*a* extending from top surface 203 between negative 202 and a front surface 204 of fixture 201. Cap 230 is disposed partially within mold negative 202 of fixture 201 and forms a portion of cutting surface 122 of tooth 120. In this embodiment, cap 230 forms chisel crest 123, a portion of each flanking surface 124 adjacent crest 123, and planar surface 144 of tooth 120.

Figure 8A:
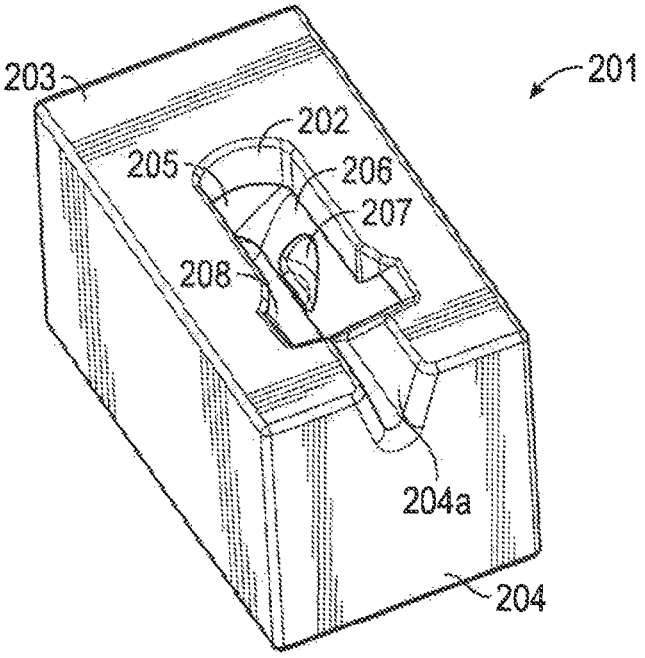
FIG. 8A is a perspective view of the fixture of FIG. 7.
Figure 8B:
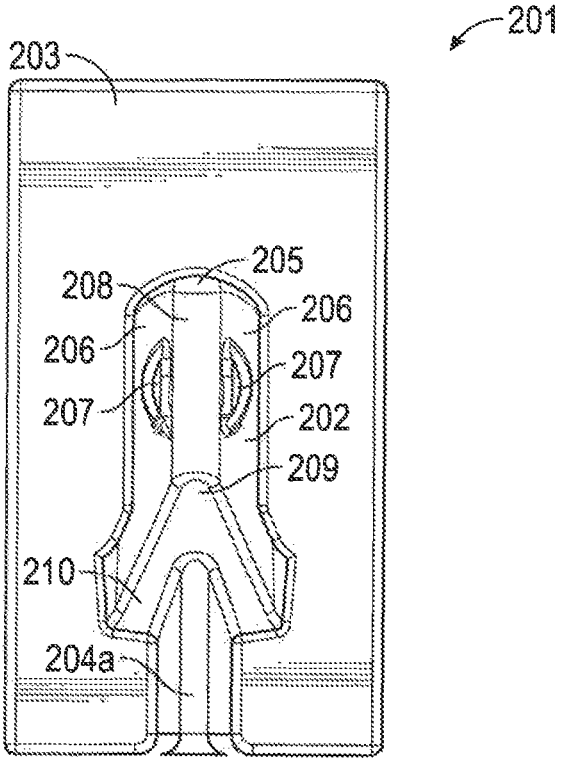
FIG. 8B is a top view of the fixture of FIG. 7.
Figure 9A:
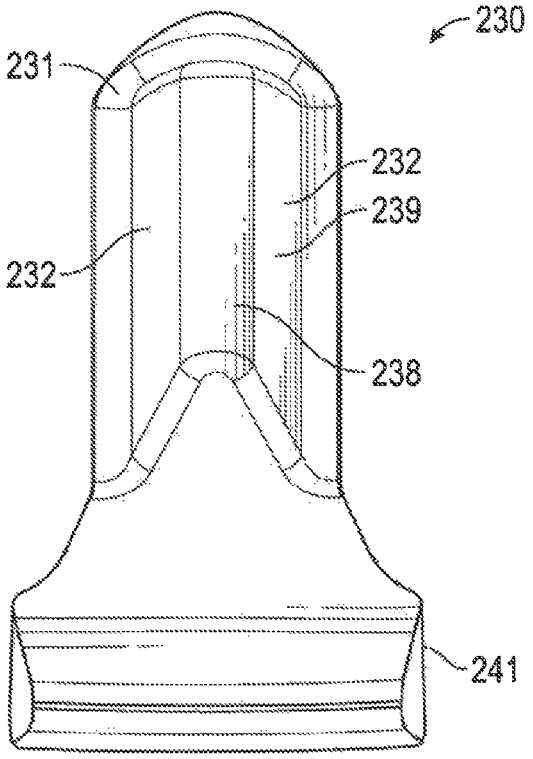
FIG. 9A is a top view of the hardened cap of FIG. 7.
Figure 9B:
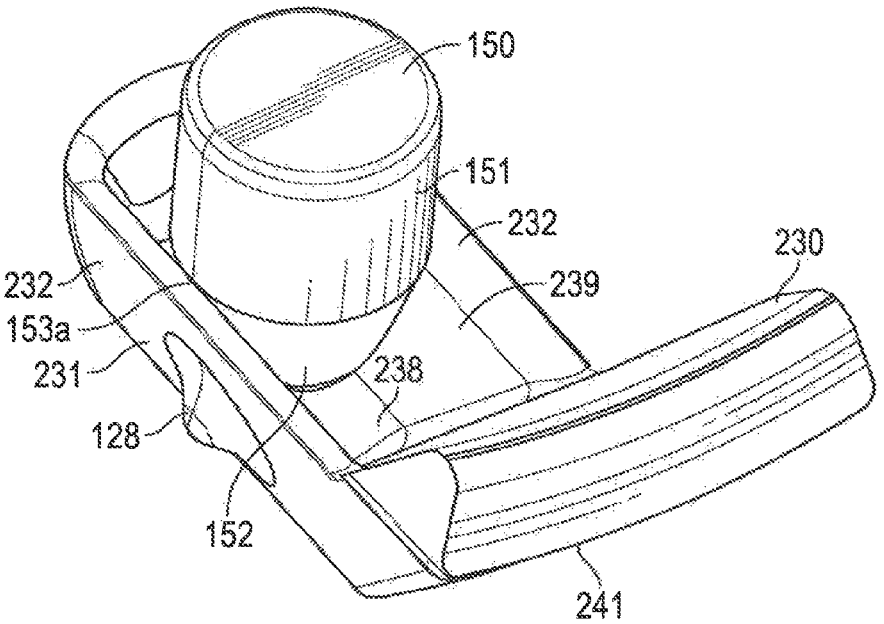
FIG. 9B is a perspective view of the insert and the hardened cap of FIG. 7.

Referring now to FIGS. 8A and 8B, recess 202 defines an inner surface 205 in fixture 201 that is generally the negative of tooth 120. More specifically, inner surface 205 includes a pair of planar flanking surfaces 206 that taper or incline towards one another moving away from top surface 203, a chisel crest recess or negative 208 with rounded corners 209 at the intersection of surfaces 206, and a planar surface 210 extending between surfaces 206. Flanking surfaces 206 include concave recesses 207. Recess 202 is sized and shaped to receive and support cap 230 removably disposed therein during the molding process.

Figure 10A:
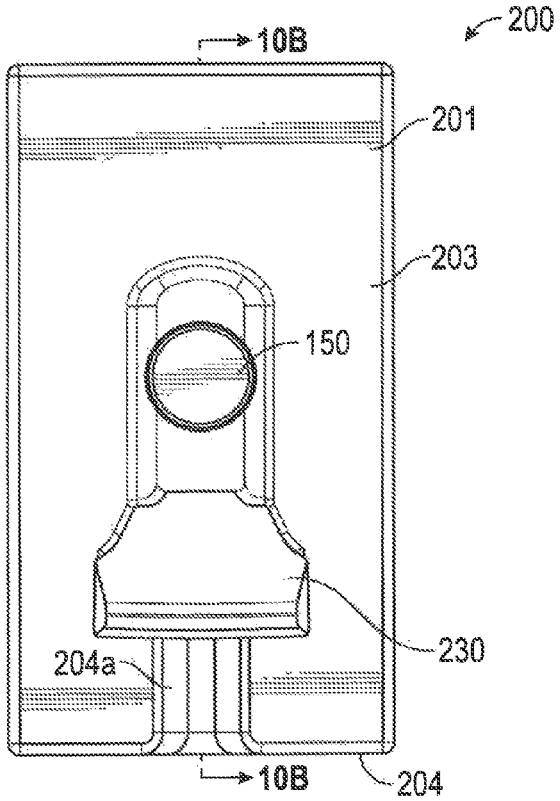
FIG. 10A is a top view of the mold assembly of FIG. 7.
Figure 10B:
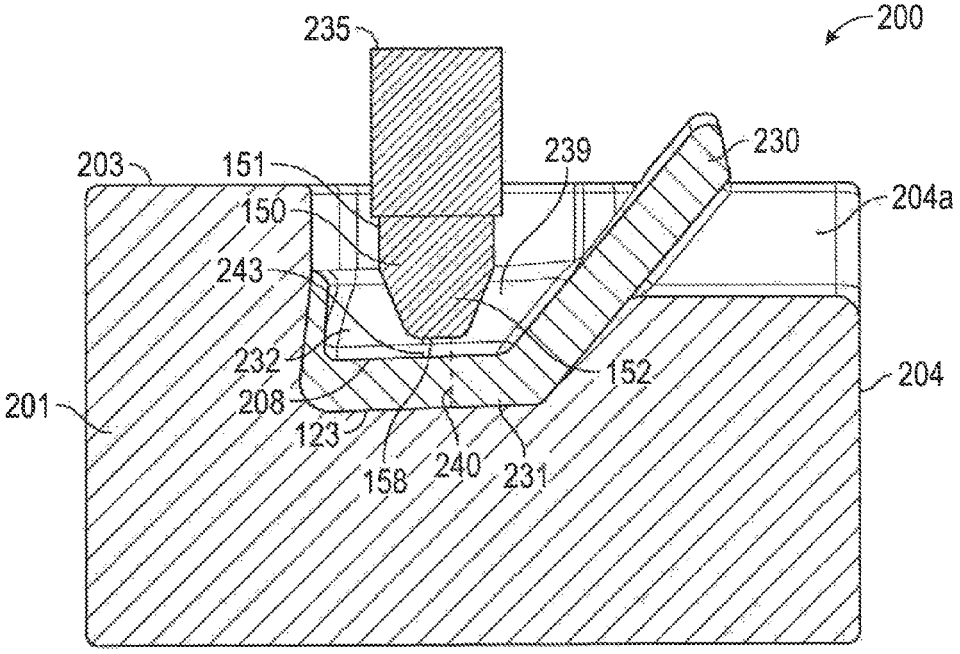
FIG. 10B is a cross-sectional view taken along line 10B-10B of FIG. 10A.

Referring now to FIGS. 9A-10B, cap 230 includes a mold portion 231 removably seated in recess 202 of fixture 201 and an elongate tang portion 241 extending from recess 202 and fixture 201. Mold portion 231 includes flanking portions 232 defining the portions of flanking surfaces 124 adjacent crest 123 and a chisel crest portion 238 defining chisel crest 123. The outer surface of each flanking portion 232 includes one protrusion 128. Tang portion 241 of cap 230 forms a portion of elongate surface 144 of tooth 120. A receptacle 239 is defined by portions 232, 238. As best shown in FIG. 10B, cutting portion 152 of insert 150 is seated in receptacle 239 with planar flanking surfaces 153*a* disposed parallel with surfaces 232 within receptacle 239. Because the cutting surface 152 of insert 150 does not physically engage any surface of cap 230, a positioning tool 235 (shown in FIG. 10B) coupled to base portion 151 suspends the cutting surface 152 of insert 150 within receptacle 239 at a predetermined position, angle (relative to axis 155) and depth (relative to surface 238 of cap 230). Thus, the positioning of the insert via tool 235 determines a spacing distance 240 between crests 123, 158 and a gap 243 within receptacle 239 between crest 123 and mold portion 231. Cap 230 is formed from a hard material such as tungsten carbide (WC). In this embodiment, cap 230 comprises approximately 65-85 WT % WC. However, in other embodiments cap 230 may be formed from other types of hard or ultrahard materials. Also, in other embodiments cap 230 may only include mold portion 231 instead of both mold portion 231 and tang portion 241. A cap similar to cap 230 may be used in other embodiments in forming inner teeth 120'. A cap for forming a tooth 120' may include a tang portion configured to act as a lateral side surface 126 of the tooth 120.

As will be described in more detail below, insert 150 is positioned within receptacle 239 of mold portion 231 as shown in FIGS. 10A and 10B via a tool coupled to base portion 151, and then the remainder of receptacle 239 is filled with filler material 260, which completely surrounds cutting portion 152 of insert 150 and flows into gap 243 between crest 123 and mold portion 231. Thus, filler material 260 is disposed below and about insert 150. The size and shape of flanking portions 232 and crest portion 238 can be varied to increase or reduce the amount of filler material 260 disposed within receptacle 239 around insert 150. For instance, the width of receptacle 239 within crest portion 238 may be increased to allow insert 150 to sit deeper within mold portion 231, thereby reducing the distance 240. Distance 240 may also be varied by manipulating the positioning of the tool coupled to insert 150. By varying distance 240 and the amount of material disposed between crests 123, 158, the amount of drilling time and associated erosion of tooth 120 before exposure of insert 150 can be varied and controlled. For example, in an application where it is desirable to increase the amount of drilling time before insert 150 is exposed to the formation due to erosion of the corresponding tooth 120, distance 240 may be increased to increase the amount of material disposed between crests 123, 158.

Referring now to FIGS. 7-11, in the embodiment shown, partially preformed tooth 120' shown in FIG. 11 is created by first forming cap 230 using a metal injection molding process. Next, as best shown in FIGS. 10A and 10B, cap 230 is placed within mating 202 of fixture 201 such that the outer surfaces of cap 230 engage the mating surfaces of mold 202; and with cap 230 sufficiently seated in fixture 201, insert 150 is positioned in receptacle 239 of mold portion 231 with flanking surfaces 153*a* disposed parallel with but not touching flank portion 232. Moving now to FIG. 7, low carbon steel filler material 260 in a paste form is poured into receptacle 239 and allowed to completely surround the portion of insert 150 within receptacle 239. Alternatively, in other embodiments filler material 260 may comprise iron, a steel alloy, WC powder, etc. Over time, the filler material 260 cures and hardens, thereby securing the position of insert 150 within cap 230 and forming partially preformed tooth 120', which is removed from fixture 201 via passage 204*a*. In another embodiment, filler material 260 may be poured into receptacle 239 prior to inserting insert 150. Thus, once material 260 has cured within receptacle 239 a hole is drilled into material 260 at a predetermined location, angle and depth. Once the hole has been drilled additional material 260 in paste form is poured into the hole followed by the insertion of insert 150 into the hole prior to the curing of material 260. The additional material 260 is allowed to cure, securing insert 150 into position.

Figure 12:
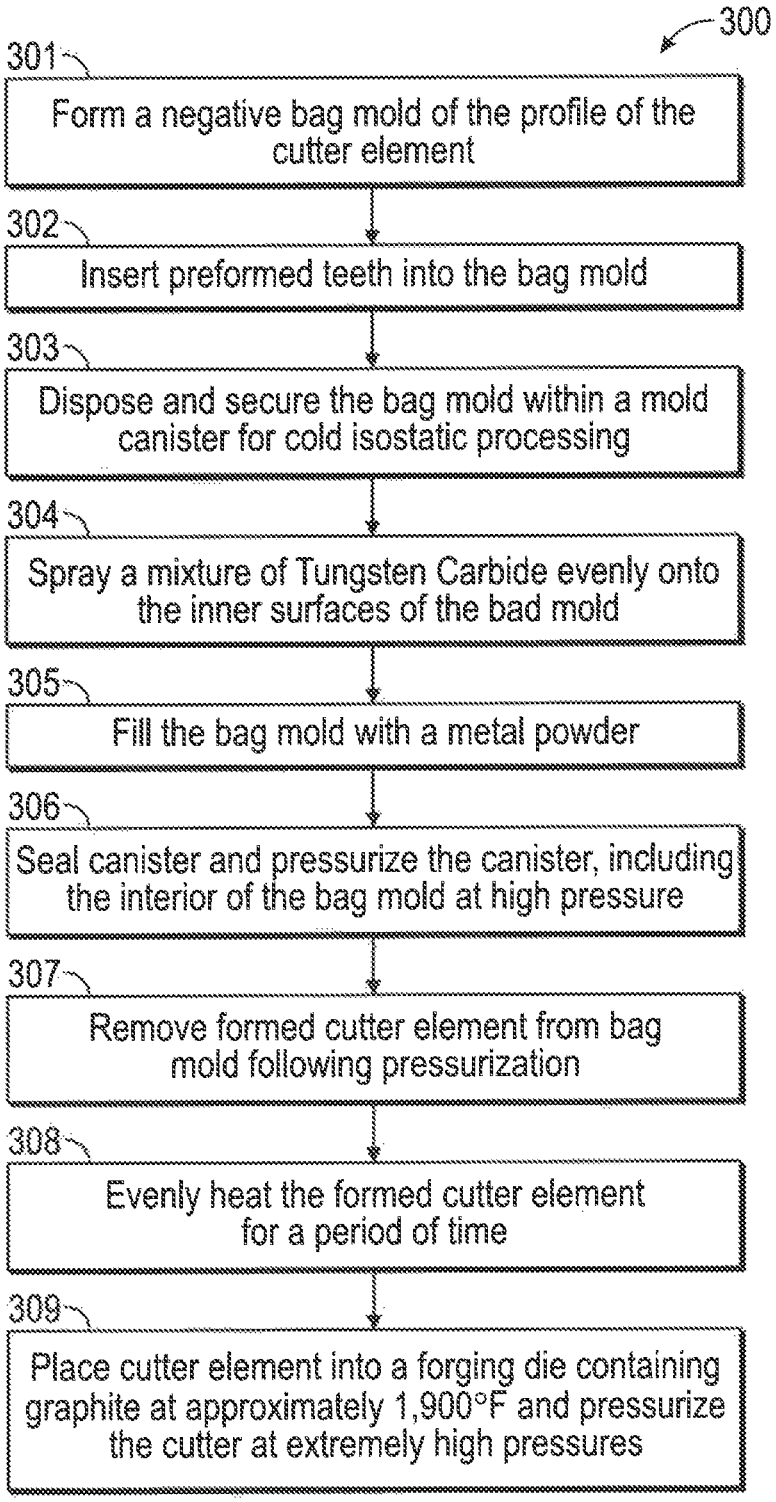
FIG. 12 is an embodiment of a method for forming a rolling cone cutter including a plurality of teeth, each with an insert disposed therein, in accordance with the principles described herein.

Referring now to FIG. 12, a method 300 for making one rolling cone cutter 100 using partially preformed teeth 120' with inserts 150 disposed therein and one partially preformed ridge cutting element 170 with inserts 150 disposed therein is schematically shown. In this embodiment, the cone body 101, the remainder of teeth 120, 120' and 171, and the integration of partially preformed teeth 120' and cutter element 170 is accomplished using cold isostatic pressing (CIP) techniques such as the Ceracon® sintering process. In particular, starting in block 301, a pliable bag mold having a cavity defined by the negative profile of cone cutter 100 is formed. An adhesive, such as Elmer's Spray Adhesive or Duro All-Purpose Spray Adhesive, etc., is preferably sprayed into the bag mold to allow adhesion between the bag mold and the materials that will be disposed therein. Moving now to block 302, the partially preformed teeth 120' previously described, as well as a partially preformed ridge cutting element 170, are positioned in the bag mold in their appropriate locations. Next, in block 303, the bag mold is disposed and secured within a high pressure canister for use in a sintering cold isostatic molding process. A mixture of WC is then sprayed evenly on the inner surfaces of the bag mold at block 304 to form a thin layer of WC on the body 101 of cone 100 (FIG. 1) to act as an erosion protecting jacket protecting cone 100. Following this, a metal powder, such as 4625 steel powder or 4815 steel powder, etc., is poured into the bag mold for forming body 101 and the remainder of teeth 120, 120' and 171 at block 205. Moving now to block 306, with the bag mold sufficiently filled with the metal powder, the canister is pressurized (e.g., approximately 40,000 psi) at step 306 to form cone cutter 100 by simultaneously forming body 101, the remainder of teeth 120, 120' and 171, and monolithically integrate partially preformed teeth 120' and ridge cutting element 170 with body 101. At block 307 cone cutter 100 is removed from the canister and the bag mold, and then heat treated at block 308 at a relatively high temperature (e.g., at approximately 2,100° F.). After removal of cone cutter 100 from the canister and bag mold, cone cutter 100 is at approximately 80% of its final density. However, at block 309, cone cutter 100 is placed within a forging die containing hot graphite (e.g., at approximately 1,900° F.) and is pressurized at extremely high pressures (e.g., approximately 3.2 million psi) to further increase the density of the element to its final density prior to use in the field. The time duration of the pressurization at block 306 may range from approximately 10 to 25 seconds and the duration of the pressurization at block 309 may range from approximately 15 to 25 seconds, depending upon the size of cone 100. Following the manufacture of rolling cone cutters 100 using method 300, cone cutters 100 are rotatably mounted to journals 20 of bit body 11 to form bit 10.

Figure 13:
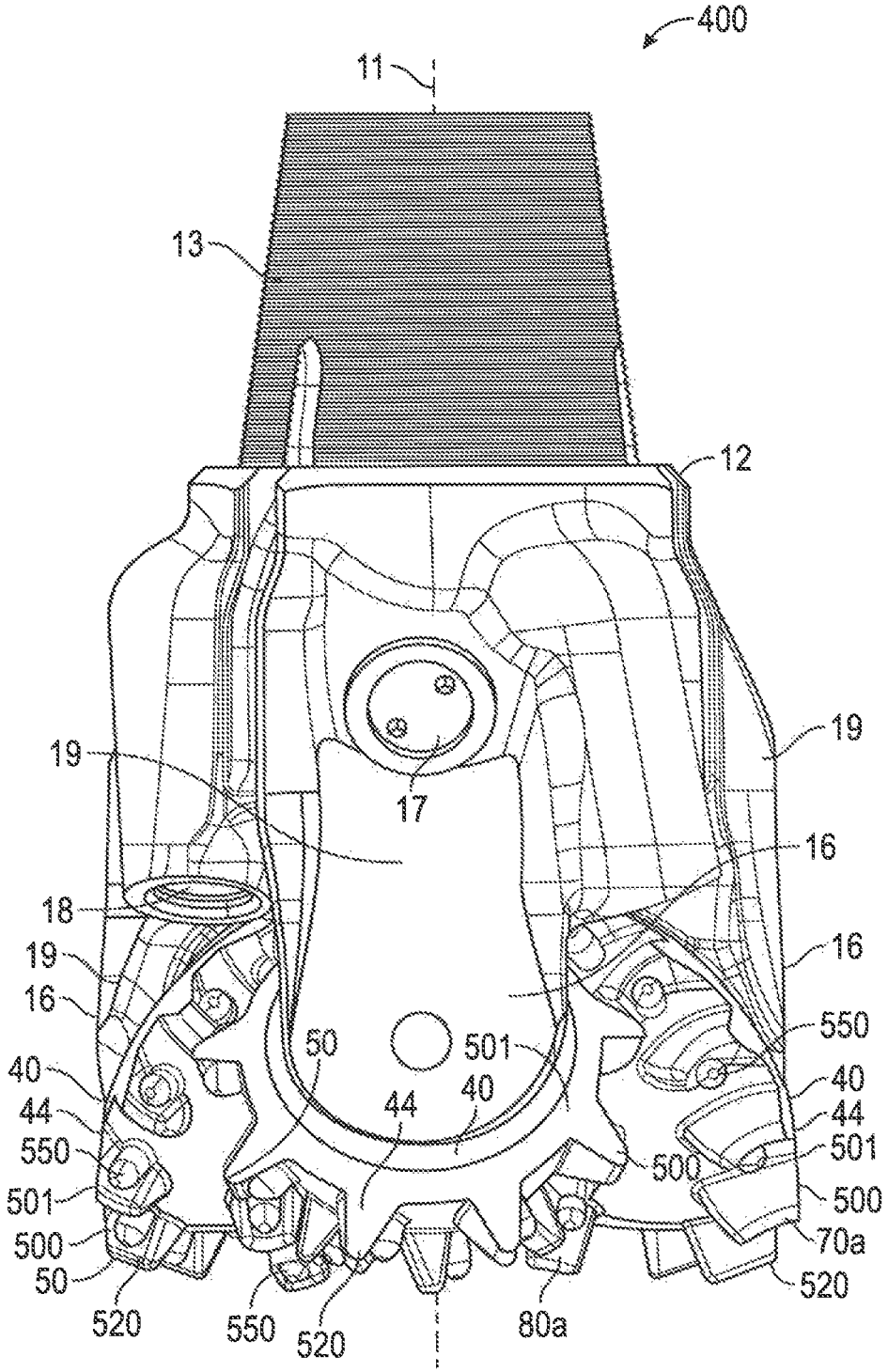
FIG. 13 is a perspective view of an embodiment of an earth-boring bit in accordance with the principles described herein.
Figure 14:
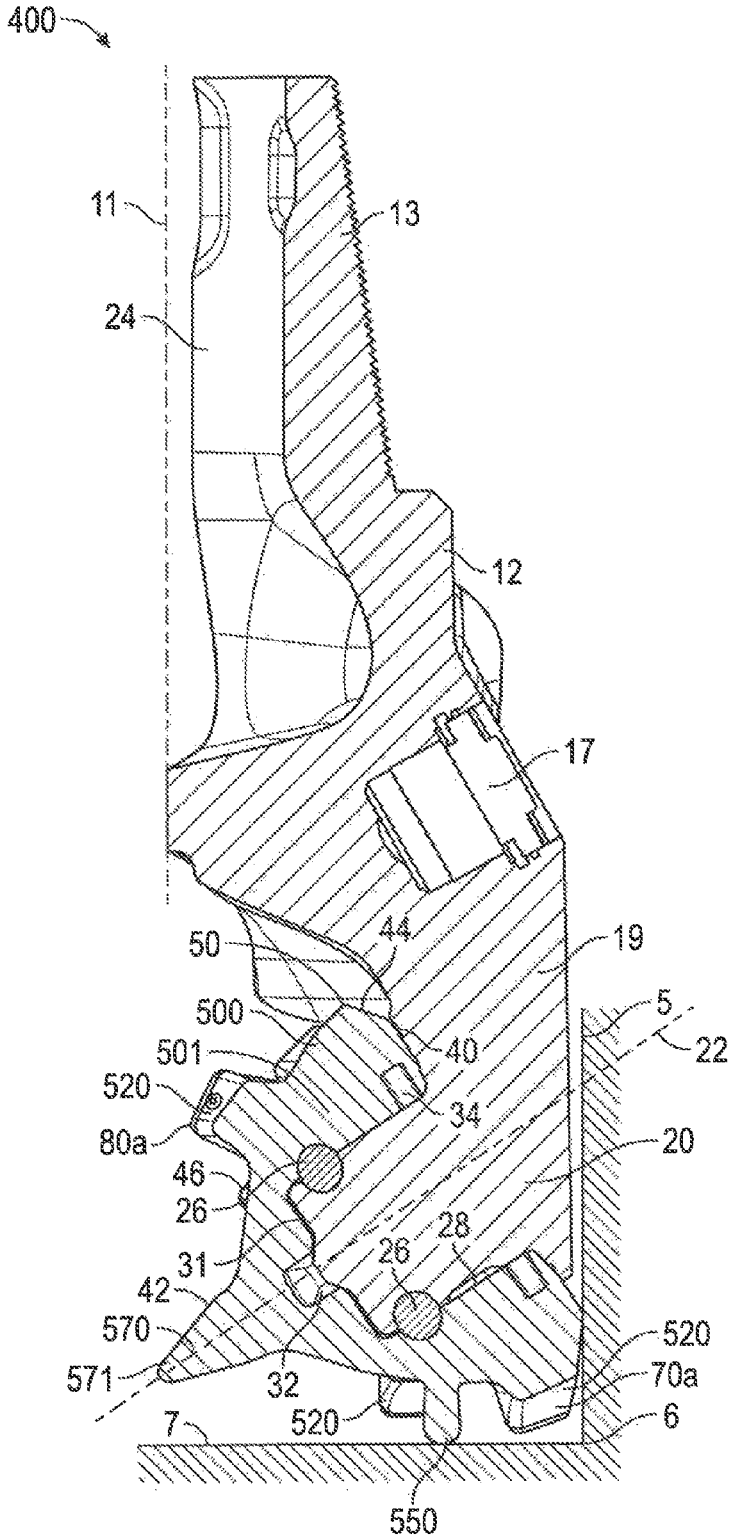
FIG. 14 is a partial cross-sectional view taken through one leg and one rolling cone cutter of the bit of FIG. 13.

Referring now to FIGS. 13 and 14, another embodiment of a rolling cone drill bit 400 is shown. Bit 400 is the same as bit 10 previously described except for the cutting structures of the rolling cone cutters. Accordingly, the same reference numerals are used to designate like-components. In this embodiment, bit 400 includes a bit body 12 as previously described and a plurality of rolling cone cutters 500 rotatably mounted on journals 20 extending from the lower ends of legs 19. Each cone cutter 500 has a central axis of rotation 22, which is also the central axis of the corresponding journal 20. During drilling operations, bit 400 is rotated about axis 11 in a clockwise cutting direction looking downward at pin end 13 along axis 11 and each cone cutter 500 rotates about axis 22 in a counterclockwise cutting direction looking at backface 40 along axis 22.

Figure 15:
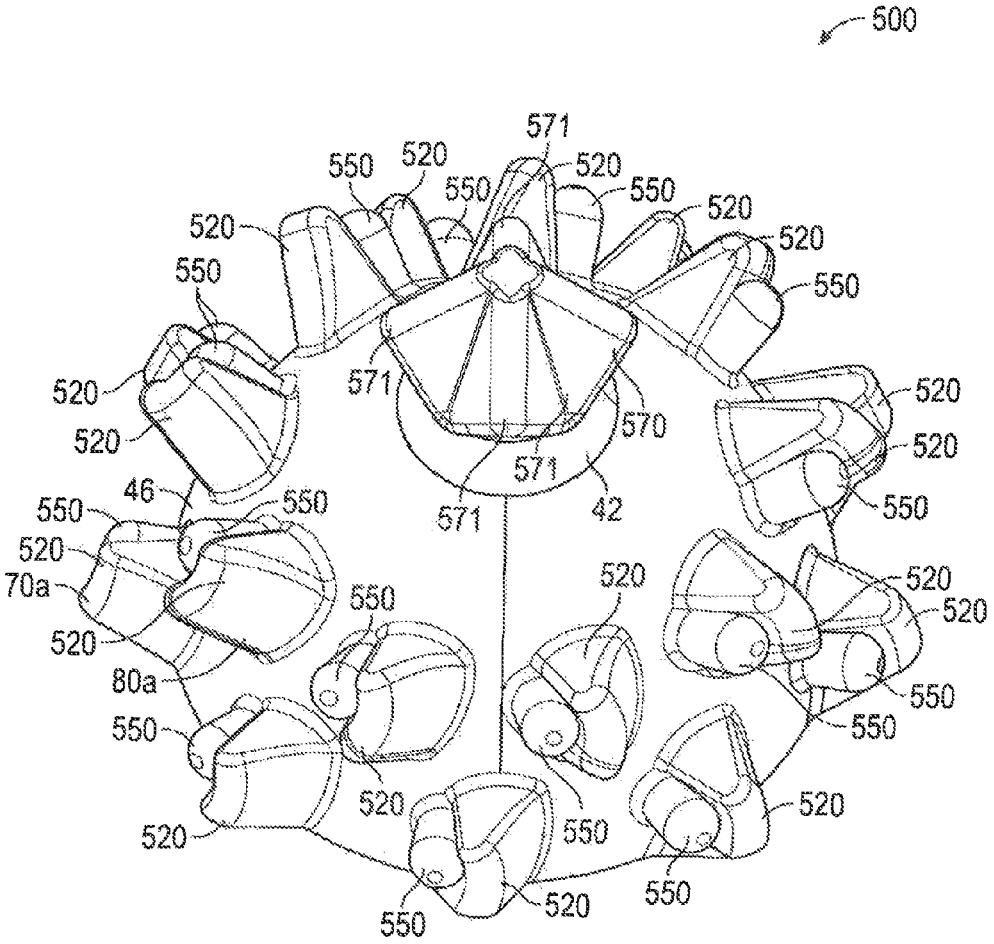
FIG. 15 is a perspective view of one of the rolling cone cutters of the bit of FIG. 13.

Referring now to FIGS. 13-15, each cone cutter 500 includes a body 501, a plurality of teeth 520 extending from body 501, and a plurality of wear resistant inserts 550 mounted to body 501. As will be described in more detail below, each insert 550 is positioned circumferentially adjacent one tooth 520, and further, each tooth 520 is integral with body 501. Thus, unlike cone cutters 100 previously described, in this embodiment, inserts 550 are not disposed inside teeth 520.

Each cone body 501 is the same as cone body 101 previously described. Namely, each cone body 501 includes a generally planar backface 40, a nose 42 opposite backface 40, a generally frustoconical heel surface 44 axially adjacent backface 40, and a generally convex curved surface 46 extending from heel surface 44 to nose 42. As best shown in FIG. 14, frustoconical heel surface 44 and convex surface 46 intersect at an annular edge or shoulder 50. Heel surface 44 is adapted to scrape or ream the borehole sidewall 5, and surface 46 supports teeth 520 and inserts 550, which gouge or crush the borehole bottom 7. Teeth and/or inserts may be provided in heel surface 44 to aid in such scraping or reaming action.

Referring now to Figures still to FIGS. 13-15, teeth 520 and inserts 550 are arranged in a plurality of axially spaced (relative to cone axis 22) circumferential rows. More specifically, each cone cutter 500 includes a first or gage circumferential row 70*a* of teeth 520 and inserts 550 extending from surface 46 axially adjacent shoulder 50 and a second circumferential row 80*a* of teeth 520 and inserts 550 extending from surface 46 and axially disposed between row 70*a* and nose 42. In this embodiment, one insert 550 is positioned immediately circumferentially adjacent each tooth 520 within each row 70*a*, 80*a*. In addition, each insert 550 trails the corresponding adjacent tooth 520 relative to the counterclockwise cutting direction of cone cutter 500 about axis 22. Thus, in this embodiment, each tooth 520 leads the associated insert 550 into the formation during drilling operations, and further, within each row 70*a*, 80*a*, teeth 520 and inserts 550 are circumferentially arranged in an alternating fashion. Teeth 520 and inserts 550 in row 70*a* function primarily to cut the corner 6 of the borehole while teeth 520 and inserts 550 in row 80*a* function to cut the borehole bottom 7. Rows 70*a* and 80*a* of teeth 120 and inserts 550 are arranged and axially spaced (relative to axis 22) on each rolling cone cutter 500 so as not to interfere with teeth 520 and inserts 550 on the other cone cutters 500 (FIG. 13).

As best shown in FIGS. 14 and 15, each cone cutter 500 is also provided with a "ridge" cutting element 570 extending from nose 42 and configured to prevent formation build-up between the cutting paths of teeth 520 and inserts 550 in rows 70*a*, 80*a*. Element 570 extends along axis 22 (FIG. 14) and includes four circumferentially adjacent teeth 571 that intersect at axis 22.

Each cone cutter 500 has a gage row 70*a* of teeth 520 and inserts 550, an inner row 80*a* of teeth 520 and inserts 550, and a ridge cutting element 570, although not identically arranged and positioned. In particular, the arrangement and spacing of teeth 520, inserts 550, and elements 570 differs as between the three cone cutters 500 in order to maximize borehole bottom coverage, and also to provide clearance for the teeth 520, inserts 550, and elements 570 on the adjacent cone cutters 500.

Each tooth 520, 571 is integral and unitary with the corresponding body 501. In other words, each tooth 520, 571 is monolithic with the corresponding body 501 such that teeth 520, 571 and the body 101 are a single-piece. On the other hand, inserts 550 are seated and secured within mating sockets in the corresponding cone body 501. As will be described in more detail below, during manufacture of each cone cutter 500, the cone body 501 is formed around inserts 550 to retain them therein.

Figure 16:
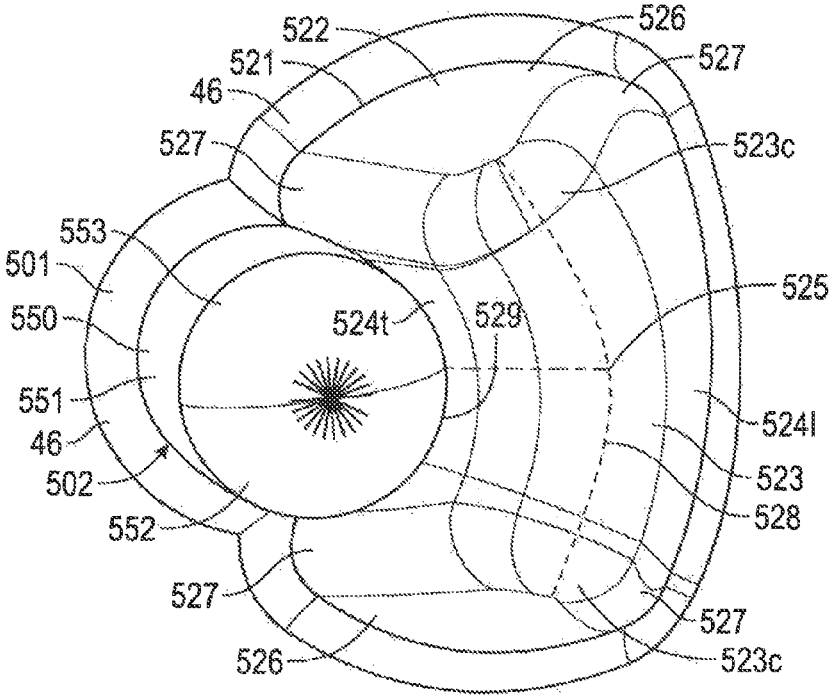
FIG. 16 is an enlarged view of one tooth and associated insert of the bit of FIG. 13.
Figure 17:
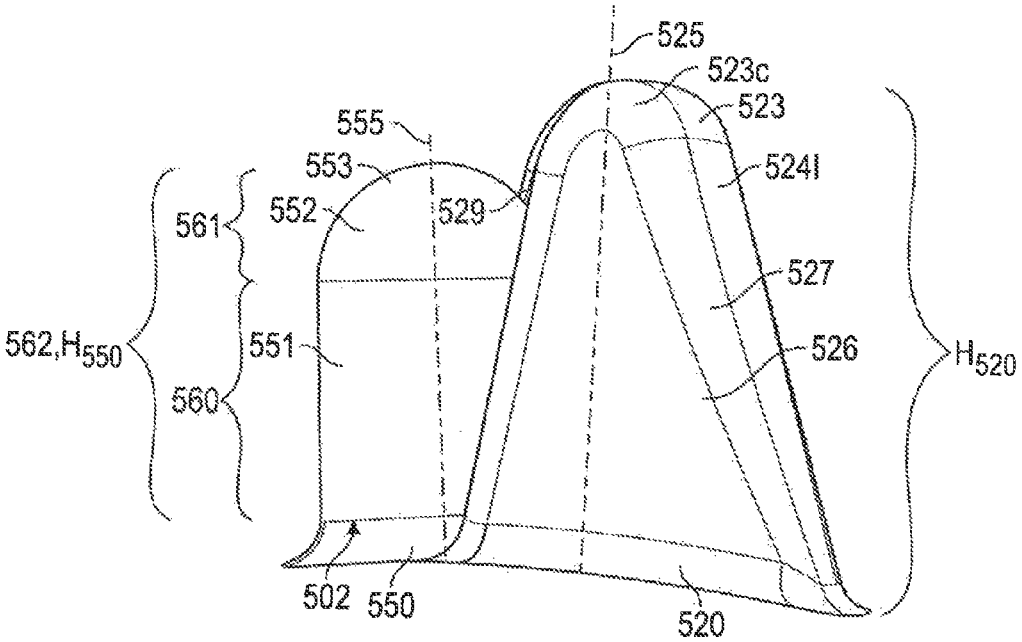
FIG. 17 is a side view of one tooth and associated insert of the bit of FIG. 13.

Referring now to FIGS. 15-17, each tooth 520 extends perpendicularly from body 501 and has a generally chisel-shaped cutting structure for engaging the formation. In particular, each tooth 520 has a central axis 525, a base 521 at surface 46, and a cutting surface 522 extending from base 521 to an elongate chisel-crest 523 distal body 501. In this embodiment, base 521 is generally C-shaped. Cutting surface 522 includes a pair of flanking surfaces 524 and a pair of convex lateral side surfaces 526. Flanking surfaces 524 taper or incline towards one another as they extend from base 521 to chisel crest 523 that extends between crest ends or corners 523*c*. In this embodiment, crest ends 523*c* are partial spheres, each defined by spherical radii. Lateral side surfaces 526 extend from base 501 to crest ends 523*c* and between flanking surfaces 524. Surfaces 524, 526 intersect at rounded edges 527 that extend from base 501 to corners 523*c* and provide a smooth transition between surfaces 524, 526.

Each tooth 520 has a leading flanking surface 524 and a trailing flanking surface 524 relative to the counterclockwise cutting direction of the corresponding cone cutter 500. For purposes of clarity and further explanation, the leading flanking surface 524 is designated with reference numeral 5241 and the trailing flanking surface 524 is designated with reference numeral 524*t*. In this embodiment, each leading flanking surface 5241 is convex or bowed outwardly and each trailing flanking surface 524*t* is concave or bowed inwardly. Consequently, the trailing flanking surface 524*t* of each tooth 520 defines a recess or pocket 529 (FIG. 17) on the trailing side of each tooth 520. Each insert 550 is seated in the pocket 527 of the associated tooth 520.

Each chisel crest 523 extends along a curved or arcuate crest median line 528. Teeth 520 are arranged and positioned such that a projection of each crest median line 528 generally extends towards cone axis 22 of the corresponding cone cutter 500.

Figure 18:
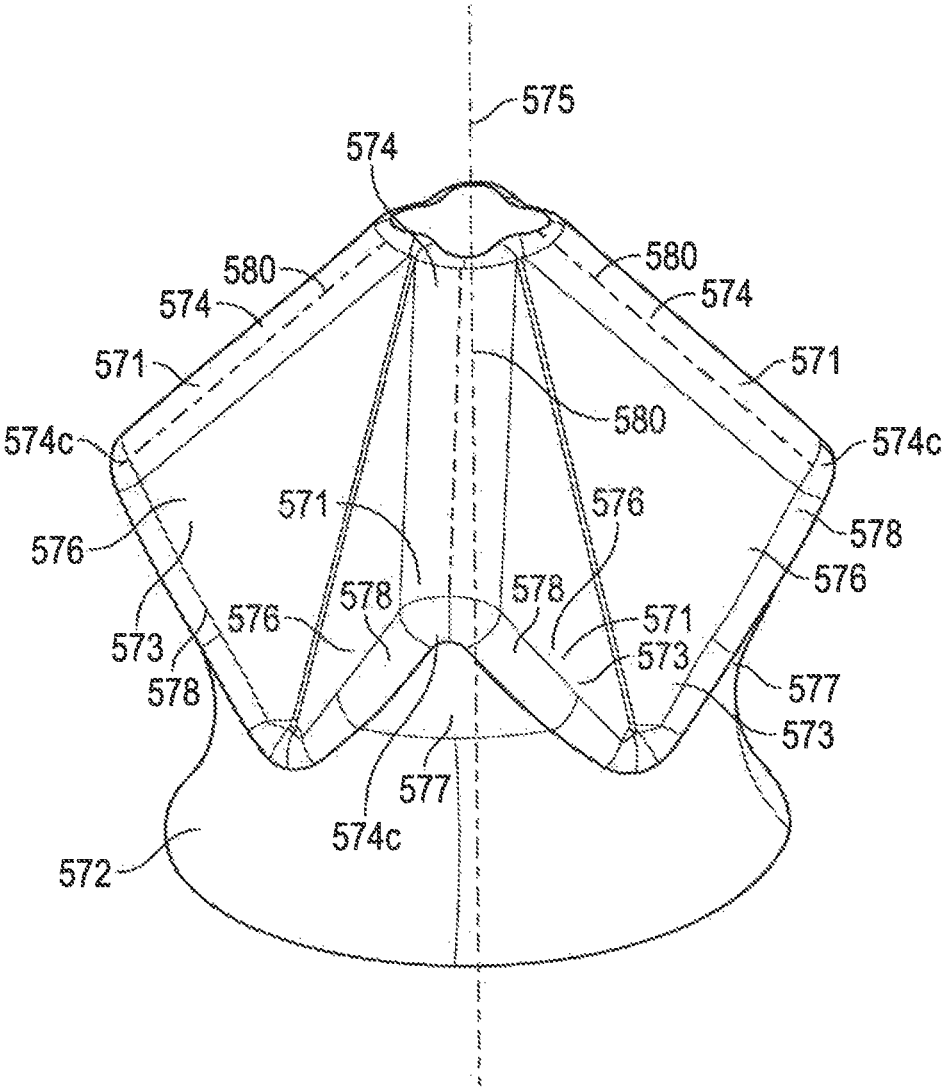
FIG. 18 is a perspective view of a ridge cutter of the bit of FIG. 13.
Figure 19:
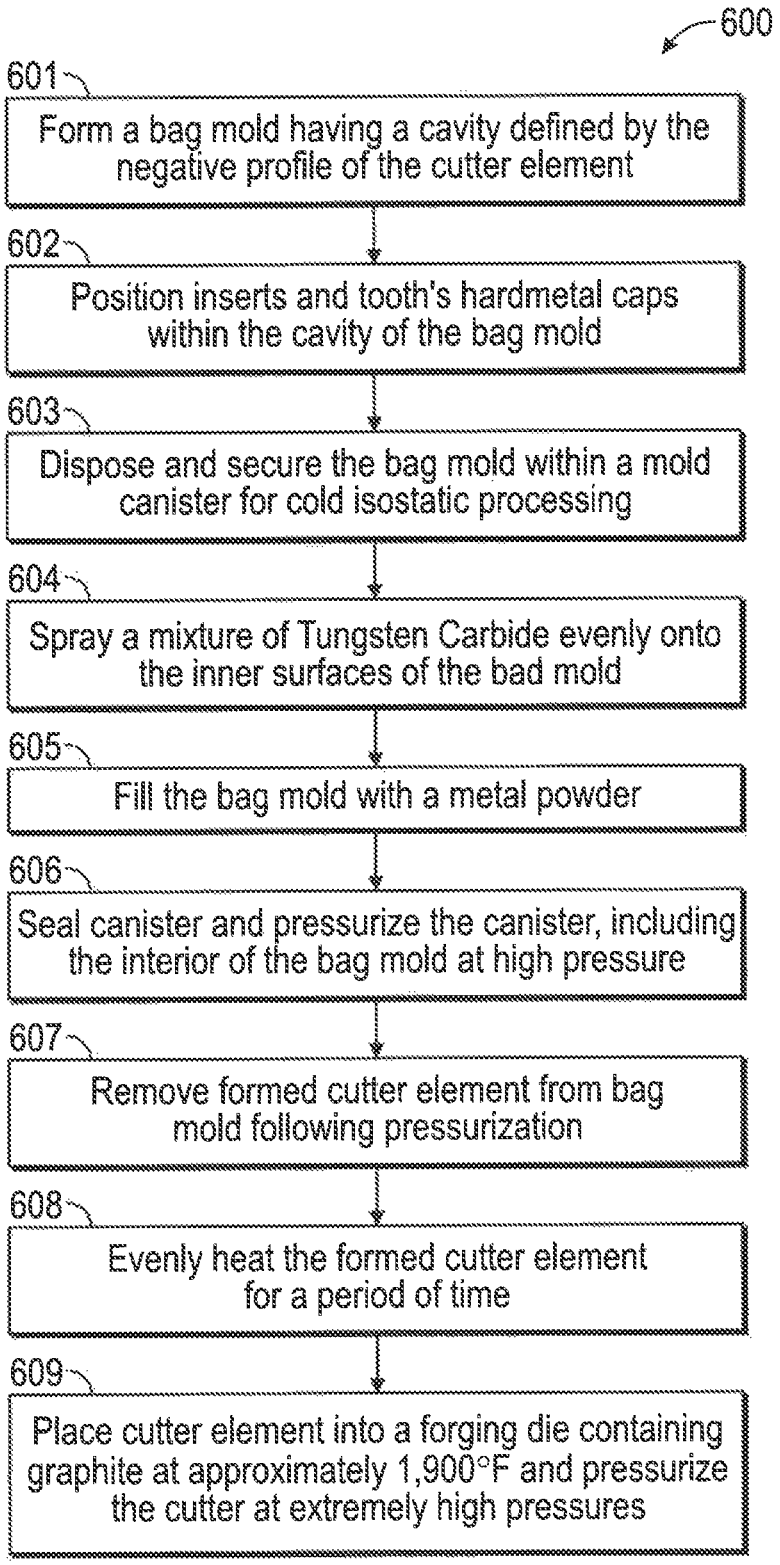
FIG. 19 is an embodiment of a method for forming a rolling cone cutter including a plurality of teeth and inserts disposed thereon, in accordance with the principles described herein.

Referring now to FIG. 18, each ridge cutting element 570 extends perpendicularly from nose 42 of body 501 and has a central axis 575 coincident with cone axis 22. Each element 570 and tooth 571 is the same as element 170 and tooth 171, respectively, previously described except that no inserts (e.g., inserts 120, 520) are disposed within elements 570 or teeth 571, and further, elements 570 and teeth 571 do not include any protrusions (e.g., protrusions 179) extending from the flanking surfaces. Thus, in this embodiment, each ridge cutter element 570 comprises four teeth 571 that intersect at axes 22, 575. Similar to teeth 171 previously described, each tooth 571 has a generally chisel-shaped cutting structure for engaging the formation. In particular, each element 570 has a generally circular base 572 at nose 42, and each tooth 571 has a cutting surface 573 extending from base 572 to an elongate chisel-crest 574 distal body 501. Each cutting surface 573 includes a pair of planar flanking surfaces 576 and a radially outer (relative to axis 22, 575) convex lateral side surface 577. Flanking surfaces 576 taper or incline towards one another as they extend from base 572 to chisel crest 574 that extends from a radially outer crest end or corner 574*c* to axes 22, 575 and crests 574 of the other teeth 571. In this embodiment, crest ends 574*c* are partial spheres, each defined by spherical radii. Lateral side surfaces 577 extend from base 572 to crest end 574*c* and between flanking surfaces 576. Surfaces 576, 577 intersect at rounded edges 578 that extend from base 572 to corner 574*c* and provide a smooth transition between surfaces 576, 577. As previously described, in this embodiment, no protrusion (e.g., protrusion 179) extends from flanking surfaces 176. Each chisel crest 574 extends linearly along a crest median line 580. Teeth 571 are arranged and positioned such that a projection of each crest median line 580 intersects cone axis 22 of the corresponding cone cutter 500.

Referring now to FIGS. 15-18, each insert 550 is seated in a socket 502 in cone body 501 and circumferentially disposed within pocket 529 defined by the concave trailing flanking surface 524*t* of the associated tooth 520. As best shown in FIGS. 16 and 17, each insert 550 includes a base portion 551 and a cutting portion 552 extending axially therefrom. Base portion 551 is disposed within one socket 502 and surrounded by cone body 501, and cutting portion 552 extends perpendicularly from surface 46 of the corresponding cone body 501. In this embodiment, base portion 551 is generally cylindrical, having a central axis 555 and an outer cylindrical surface 556. Each insert 550 is positioned and oriented such that its axis 555 is generally parallel to axis 525 of the associated tooth 520.

Cutting portion 552 has an outer cylindrical surface 553 extending axially from base portion 551 and a semi-spherical or dome-shaped cutting surface 554 extending from cylindrical surface 553 and distal base portion 551. Base portion 551 has an axial height 560 (FIG. 17), and cutting portion 552 has an axial height 561. Collectively, base 551 and cutting portion 552 define the insert's overall height 562. Although cutting portion 552 has a semi-spherical cutting surface 553 in this embodiment, in other embodiments, the cutting portion of the insert (e.g., cutting portions 552) can have other geometries such as conical, hyperbolic or chisel-crested.

As previously described, for some drilling applications, it may be beneficial to have a cutting structure configured to operate in a formation that includes both soft and hard formation regions. For instance, a "hybrid" bit such as bit 400 including teeth 520, 571 and inserts 550 offers the potential to enable drilling of a formation having both soft and hard regions without the need for swapping the bit in order to maintain a high ROP. Specifically, referring to FIG. 13, teeth 520 and inserts 550 are positioned in rows 70*a*, 80*a* such that each tooth 520 leads its associated insert 550 into the formation relative to counterclockwise cutting direction of the corresponding cone cutter 500. In addition, as best shown in FIG. 16B, each tooth 520 has an extension height $H_{520}$ equal to the distance from cone surface 46 to the outermost point of cutting surface 522 and crest 523 as measured parallel to axis 525 and perpendicular to cone surface 46, and each insert 550 has an extension height $H_{550}$ equal to the distance from cone surface 46 to the outermost point of cutting portion 552 as measured parallel to axis 555 and perpendicular to cone surface 46. In this embodiment, each tooth 520 has the same extension height $H_{520}$ and each insert 550 has the same extension height $H_{550}$. Further, in this embodiment, extension height $H_{520}$ of each tooth 520 is greater than the extension height $H_{550}$ of the associated insert 550. Thus, during the initial stages of drilling (i.e., before teeth 520 have been worn down), teeth 520 engage the formation before corresponding inserts 550 and penetrate the formation to a greater degree than corresponding inserts 550. Further, due to the leading positions of teeth 520, the differences in extension heights $H_{520}$, $H_{550}$, and the positioning of inserts 550 within pockets 529, inserts 550 are shielded and protected by teeth 520 during the initial stages of drilling.

During drilling operations, softer regions of the formation are often encountered first, followed by harder regions of formation. Thus, by positioning teeth 520 in leading positions relative to the corresponding inserts 550 and protecting inserts 550 with teeth 520, teeth 520 provide the initial primary cutting structure in softer formations, while inserts 550 provide the initial secondary cutting structure in softer formations; whereas inserts 550 provide the primary cutting structure in harder formations as teeth 520 wear, and teeth 520 provide the secondary cutting structure in harder formations as they are worn. In other words, teeth 520 sacrificially erode during the initial stages of drilling operations, thereby transferring the primary cutting duty to inserts 550 for subsequent stages of drilling operations where harder regions of the formation are encountered.

Referring now to FIG. 18, a method 600 for making one rolling cone cutter 500 is schematically shown. Method 600 is similar to method 300 previously described except that teeth 520 are not partially preformed to include an insert disposed therein. Namely, in this embodiment, cone body 501, teeth 520, 571, the integration of teeth 520, 571 into cone body 501, and the securement of inserts 550 to body 501 are accomplished using known isostatic processing techniques such as the Ceracon® sintering process. In particular, starting in block 601, a pliable bag mold having a cavity defined by the negative profile of cone cutter 500 is formed. An adhesive, such as Elmer's Spray Adhesive or Duro All-Purpose Spray Adhesive, is preferably sprayed into the bag mold to allow adhesion between the bag mold and the materials that will be disposed therein. Moving now to block 602, inserts 550 previously described and a hardmetal preformed cap for each tooth 520 are positioned in the bag mold in their appropriate locations. In this embodiment, the hardmetal caps placed in the bag mold define at least a portion of the cutting surface 522 for each tooth 520. Next, in block 603, the bag mold is disposed and secured within a high pressure canister for use in a sintering cold isostatic molding process. A mixture of tungsten carbide is then sprayed evenly on the inner surfaces of the bag mold at block 604, and then a metal powder, such as 4625 or 4815 steel powders, is poured into the bag mold for forming body 501 and teeth 520, 571 at block 605. The metal powder completely surrounds base portions 551 of inserts 550 positioned in the bag mold. Moving now to block 606, with the bag mold sufficiently filled with the metal powder, the canister is pressurized (e.g., approximately 40,000 psi) at step 606 to form cone cutter 500 by simultaneously forming body 501, teeth 520, 571, monolithically integrating teeth 520, 571 with body 501, and securing inserts 550 within sockets 502. At block 607 cone cutter 500 is removed from the canister and the bag mold, and then heat treated at block 608 at a relatively high temperature (e.g., at approximately 2,100° F.). After removal of cone cutter 500 from the canister and bag mold, cone cutter 500 is at approximately 80% of its final density. However, at block 609, cone cutter 500 is placed within a forging die containing hot graphite (e.g., at approximately 1,900° F.) and is pressurized at extremely high pressures (e.g., approximately 3.2 million psi) to further increase the density of the element to its final density prior to use in the field. The time duration of the pressurization at block 606 may range from approximately 10 to 25 seconds and the duration of the pressurization at block 609 may range from approximately 15 to 25 seconds, depending upon the size of cone 500. Following the manufacture of rolling cone cutters 500 using method 600, cone cutters 500 are rotatably mounted to journals 20 of bit body 11 to form bit 400. In the manner described, inserts 550 are secured within sockets 502 by forming cone body 501 around base portions 521 of inserts 550 in this embodiment.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

The invention claimed is:

1. A rolling cone drill bit for drilling a borehole in earthen formations, the bit comprising:

a bit body having a bit axis; and a rolling cone cutter mounted on the bit body and having a cone axis of rotation;

wherein the cone cutter includes a cone body, a plurality of circumferentially-spaced teeth monolithically formed with the cone body and arranged in a first inner row, and a plurality of inserts disposed in the first inner row, wherein each pair of circumferentially adjacent teeth comprises a leading tooth relative to a direction of cone rotation about the cone axis and a trailing tooth relative to a direction of cone rotation about the cone axis;

wherein each insert in the first inner row is circumferentially positioned between one of the pairs of circumferentially adjacent teeth, wherein each insert is circumferentially proximal the leading tooth of the corresponding pair of circumferentially adjacent teeth and distal the trailing tooth of the corresponding pair of circumferentially adjacent teeth;

wherein the leading tooth of each pair of circumferentially adjacent teeth at least partially surrounds the corresponding insert.

2. The drill bit of claim 1, wherein each tooth in the first inner row has a cutting surface with a curved chisel crest.

3. The drill bit of claim 1, wherein each tooth in the first inner row has an extension height and each insert in the first inner row has an extension height that is less than the extension height of the immediately circumferentially adjacent tooth.

4. The drill bit of claim 1, wherein the extension height of each tooth in the first inner row is the same and the extension height of each insert in the first inner row is the same.

5. The drill bit of claim 1, wherein the cone cutter includes a plurality of teeth arranged in a gage row and a plurality of inserts disposed in the gage row;

wherein each insert in the gage row is positioned immediately circumferentially adjacent one tooth in the gage row, and wherein each insert in the gage row trails the immediately circumferentially adjacent tooth in the gage row relative to a direction of cone rotation about the cone axis.

6. The drill bit of claim 1, wherein each tooth in the first inner row has a convex leading flanking surface relative to the direction of cone rotation, a concave trailing flanking surface relative to the direction of cone rotation, and a chisel crest disposed at the intersection of the leading flanking surface and the trailing flanking surface;

wherein each insert in the first inner row is positioned in a pocket defined by the concave trailing flanking surface of one of the teeth in the first inner row.

7. The drill bit of claim 1, further comprising a plurality of rolling cone cutters mounted on the bit body, each cone cutter having a cone axis of rotation;

wherein each cone cutter includes a cone body, a plurality of teeth arranged in a first inner row, and a plurality of inserts disposed in the first inner row;

wherein each insert in the first inner row of each cone cutter is positioned immediately circumferentially adjacent one tooth in the first inner row of each cone cutter, and wherein each insert in the first inner row of each cone cutter trails the immediately circumferentially adjacent tooth relative to a direction of cone rotation of the corresponding cone cutter about the cone axis.

8. The drill bit of claim 7, wherein each tooth in the first inner row of each cone cutter has a convex leading flanking surface relative to the direction of cone rotation of the corresponding cone cutter, a concave trailing flanking surface relative to the direction of cone rotation of the corresponding cone cutter, and a chisel crest disposed at the intersection of the leading flanking surface and the trailing flanking surface;

wherein each insert in the first inner row of each cone cutter is positioned in a pocket defined by the concave trailing flanking surface of one of the teeth in the first inner row of each cone cutter.

9. The drill bit of claim 7, wherein each tooth in the first inner row has an extension height and each insert in the first inner row has an extension height that is less than the extension height of the immediately circumferentially adjacent tooth.

10. The drill bit of claim 7, wherein each cone cutter includes a plurality of teeth arranged in a gage row and a plurality of inserts disposed in the gage row;

wherein each insert in the gage row of each cone cutter is positioned immediately circumferentially adjacent one tooth in the gage row, and wherein each insert in the gage row of each cone cutter trails the immediately circumferentially adjacent tooth in the gage row relative to a direction of cone rotation of the corresponding cone cutter about the cone axis.

11. The drill bit of claim 1, wherein the teeth define a primary cutting structure and the inserts define a secondary cutting structure configured to engage and drill the earthen formation after the teeth erode.

12. A rolling cone drill bit for drilling a borehole in earthen formations, the bit comprising:

a bit body having a bit axis; and a rolling cone cutter mounted on the bit body and having a cone axis of rotation;

wherein the cone cutter includes a cone body, a plurality of circumferentially-spaced teeth monolithically formed with the cone body and arranged in a first inner row, and a plurality of circumferentially-spaced inserts disposed in the first inner row, wherein each pair of circumferentially adjacent teeth comprises a leading tooth relative to a direction of cone rotation about the cone axis and a trailing tooth relative to a direction of cone rotation about the cone axis;

wherein each tooth in the first inner row has a convex leading flanking surface relative to the direction of cone rotation, a concave trailing flanking surface relative to the direction of cone rotation, and a curved chisel crest disposed at the intersection of the leading flanking surface and the trailing flanking surface;

wherein each insert in the first inner row is positioned in a pocket defined by the concave trailing flanking surface of the corresponding leading tooth in the first inner row.

13. The drill bit of claim 12, wherein each insert in the first inner row is circumferentially positioned between one of the pairs of circumferentially adjacent teeth.

14. The drill bit of claim 13, wherein each insert is circumferentially proximal the leading tooth of the corresponding pair of circumferentially adjacent teeth and distal the trailing tooth of the corresponding pair of circumferentially adjacent teeth.

15. The drill bit of claim 14, wherein each insert is immediately circumferentially adjacent the leading tooth of the corresponding pair of circumferentially adjacent teeth.

16. The drill bit of claim 12, wherein each tooth in the first inner row has an extension height and each insert in the first inner row has an extension height that is less than the extension height of each of the pair of circumferentially adjacent teeth.

* * * * *